US012735827B2

(12) United States Patent
Baek et al.

(10) Patent No.: US 12,735,827 B2
(45) Date of Patent: Sep. 15, 2026

(54) CLOTHES CARE APPARATUS

(71) Applicant: Samsung Electronics Co., Ltd., Suwon-si (KR)

(72) Inventors: Kwanwoo Baek, Suwon-si (KR); Zoohyeong Kim, Suwon-si (KR); Younghyun Kim, Suwon-si (KR); Jongwon Park, Suwon-si (KR); Changwoo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 14 days.

(21) Appl. No.: 18/746,826

(22) Filed: Jun. 18, 2024

(65) Prior Publication Data

US 2025/0003135 A1 Jan. 2, 2025

Related U.S. Application Data

(63) Continuation of application No. PCT/KR2024/008009, filed on Jun. 12, 2024.

(30) Foreign Application Priority Data

Jun. 30, 2023 (KR) ..... 10-2023-0085252
Aug. 31, 2023 (KR) ..... 10-2023-0115785
Jan. 3, 2024 (KR) ..... 10-2024-0001050

(51) Int. Cl.
*D06F 37/26* (2006.01)
*D06F 25/00* (2006.01)
(Continued)

(52) U.S. Cl.
CPC ..... *D06F 37/264* (2013.01); *D06F 25/00* (2013.01); *D06F 37/04* (2013.01); *D06F 39/04* (2013.01);
(Continued)

(58) Field of Classification Search
CPC ..... D06F 58/04; D06F 37/267; D06F 37/04; D06F 58/20; D06F 39/04; D06F 25/00;
(Continued)

(56) References Cited

U.S. PATENT DOCUMENTS 6,530,245 B1 3/2003 Kawabata et al.
7,188,437 B2 3/2007 Lee et al.
(Continued)

FOREIGN PATENT DOCUMENTS

CN 102409507 4/2012
CN 213086366 U 4/2021
(Continued)

OTHER PUBLICATIONS

Machine Translation of KR 1020230057787 to Kang et al., May 2023. (Year: 2023).*
(Continued)

*Primary Examiner* — Benjamin L Osterhout
(74) *Attorney, Agent, or Firm* — Nixon & Vanderhye P.C.

(57) ABSTRACT

A clothes care apparatus includes: a housing in which a laundry inlet is formed on a front; a tub provided in the housing and configured to store water and including a tub back forming a rear side of the tub; a drum configured to be rotatable in the tub and accommodate laundry; and a drying device disposed above the tub, and configured to remove moisture from air exhausted from the tub and supply heated air to the tub, wherein the tub back includes: a plurality of reinforcing ribs protruding rearward to reinforce a rigidity of the tub back; and a tub duct formed in a portion of the tub back, configured to guide the air exhausted from the tub to the drying device.

14 Claims, 17 Drawing Sheets

(51) Int. Cl.

| | |
|---|---|
| ***D06F 37/04*** | (2006.01) |
| ***D06F 37/30*** | (2020.01) |
| ***D06F 39/04*** | (2006.01) |
| *D06F 58/02* | (2006.01) |
| *D06F 58/04* | (2006.01) |
| *D06F 58/20* | (2006.01) |

(52) U.S. Cl.
CPC ..... *D06F 37/267* (2013.01); *D06F 37/304* (2013.01); *D06F 58/02* (2013.01); *D06F 58/04* (2013.01); *D06F 58/20* (2013.01); *D06F 58/206* (2013.01)

(58) Field of Classification Search
CPC ..... D06F 37/264; D06F 58/02; D06F 58/206; D06F 37/304
See application file for complete search history.

(56) References Cited

U.S. PATENT DOCUMENTS

| | | | |
|---|---|---|---|
| 10,590,583 | B2 | 3/2020 | Kitayama |
| 11,168,429 | B2 | 11/2021 | Kim et al. |
| 2005/0132603 | A1 | 6/2005 | Jeong et al. |
| 2020/0299892 | A1 | 9/2020 | Hahm et al. |
| 2024/0167208 | A1 | 5/2024 | Kang et al. |

FOREIGN PATENT DOCUMENTS

| | | | | | |
|---|---|---|---|---|---|
| CN | 113355838 | | | 9/2021 | |
| CN | 114687106 | A | | 7/2022 | |
| CN | 115679608 | A | | 2/2023 | |
| DE | 112006003872 | T5 | * | 3/2009 | ..... D06F 37/269 |
| EP | 1094141 | A2 | | 4/2001 | |
| EP | 1116812 | A1 | * | 7/2001 | ..... D06F 23/06 |
| EP | 1707662 | A2 | * | 10/2006 | ..... H02K 1/187 |
| EP | 2412861 | | | 2/2012 | |
| EP | 2412861 | A1 | | 2/2012 | |
| EP | 2390400 | B1 | * | 6/2016 | ..... D06F 34/16 |
| JP | 3517618 | B2 | | 1/2004 | |
| JP | 2010-012088 | | | 1/2010 | |
| KR | 10-0354949 | | | 10/2002 | |
| KR | 10-2005-0062869 | | | 6/2005 | |
| KR | 100644834 | B1 | | 11/2006 | |
| KR | 101453267 | B1 | * | 10/2014 | ..... D06F 23/02 |
| KR | 10-2020-0022691 | | | 3/2020 | |
| KR | 20200112166 | A | | 10/2020 | |
| KR | 102369335 | B1 | | 3/2022 | |
| KR | 20220114165 | A | * | 8/2022 | ..... D06F 58/08 |
| KR | 20220122240 | A | * | 9/2022 | ..... D06F 58/20 |
| KR | 10-2023-0057787 | | | 5/2023 | |
| TW | 1352763 | B | * | 11/2011 | ..... D06F 58/04 |
| WO | WO-2007132955 | A1 | * | 11/2007 | ..... D06F 37/264 |

OTHER PUBLICATIONS

Machine Translation of CN 113355838 to Feng et al., Sep. 2021. (Year: 2021).*

Machine Translation of JP 2010-012088 to Matsuoka et al., Jan. 2010. (Year: 2010).*

Search Report and Written Opinion dated Sep. 27, 2024 issued in International Patent Application No. PCT/KR2024/008009.

Extended European Search Report dated Jun. 5, 2026 issued in European Patent Application No. 24832326.3.

* cited by examiner

CLOTHES CARE APPARATUS

CROSS-REFERENCE TO RELATED APPLICATIONS

This application is a continuation of International Application No. PCT/KR2024/008009 designating the United States, filed on Jun. 12, 2024, in the Korean Intellectual Property Receiving Office and claiming priority to Korean Patent Application Nos. 10-2023-0085252, filed on Jun. 30, 2023, 10-2023-0115785, filed on Aug. 31, 2023, and 10-2024-0001050, filed on Jan. 3, 2024, in the Korean Intellectual Property Office, the disclosures of each of which are incorporated by reference herein in their entireties.

BACKGROUND

Field

The disclosure relates to a clothes care apparatus including a drying device.

Description of Related Art

A clothes care apparatus may refer to a device for treating and/or caring for clothes. A clothes care apparatus may include a washing machine and a dryer.

A washing machine is an apparatus for washing laundry in a tub by mutual friction by stirring the laundry, water, and a detergent together with a driving force of a drum motor.

The processes performed by a washing machine, regardless of the type of washing machine, include a washing process of supplying a detergent and water into a tub accommodating laundry and washing the laundry while rotating a drum, a rinsing process of rinsing the laundry by supplying water into the tub and rotating the drum, and a spin-drying process of discharging water from the tub and rotating the drum to remove water from the laundry.

The processes performed by the washing machine may include a drying process for drying the laundry by blowing heat generated by a drying device into a space accommodating the laundry. The washing machine may include the drying device for performing the drying process.

SUMMARY

Embodiments of the disclosure provide a clothes care apparatus with an improved structure to improve space utilization inside the clothes care apparatus.

Embodiments of the disclosure provide a clothes care apparatus in which an exhaust flow path is formed integrally with a portion of a tub back.

Embodiments of the disclosure provide a clothes care apparatus with an improved structure to reinforce a rigidity of a tub.

Technical objects that can be achieved by disclosure are not limited to the above-mentioned objects, and other technical objects not mentioned will be clearly understood by one of ordinary skill in the art to which disclosure belongs from the following description.

According to an example embodiment of the disclosure, a clothes care apparatus may include: a housing including a laundry inlet formed on a front; a tub provided in the housing and configured to store water and including a tub back forming a rear side of the tub; a drum configured to be rotatable in the tub and accommodate laundry; and a drying device disposed above the tub, and configured to remove moisture from air exhausted from the tub and supply heated air to the tub, wherein the tub back may include: a plurality of reinforcing ribs protruding rearward to reinforce a rigidity of the tub back; and a tub duct formed in a portion of the tub back, configured to guide the air exhausted from the tub to the drying device, and including a tub exhaust port configured to exhaust air in the tub and a recess portion recessed further forward than rear ends of the plurality of reinforcing ribs.

According to an example embodiment of the disclosure, a clothes care apparatus may include: a housing including a laundry inlet is formed on a front; a tub provided in the housing, and configured to store water, and includes a tub back, including a plurality of reinforcing ribs protruding rearward to reinforce a rigidity of the tub back, and a tub duct including a tub exhaust port formed in a portion of the tub back and configured to exhaust air in the tub and a recess portion that is provided around the tub exhaust and is recessed further forward than rear ends of the plurality of reinforcing ribs; a drum configured to be rotatable in the tub and accommodate laundry; and a drying device disposed above the tub, and configured to remove moisture from air exhausted from the tub and supply heated air to the tub, and may further include a duct cover coupled to the tub to form an exhaust flow path configured to guide air, exhausted through the tub exhaust port, to the drying device by covering the tub duct.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
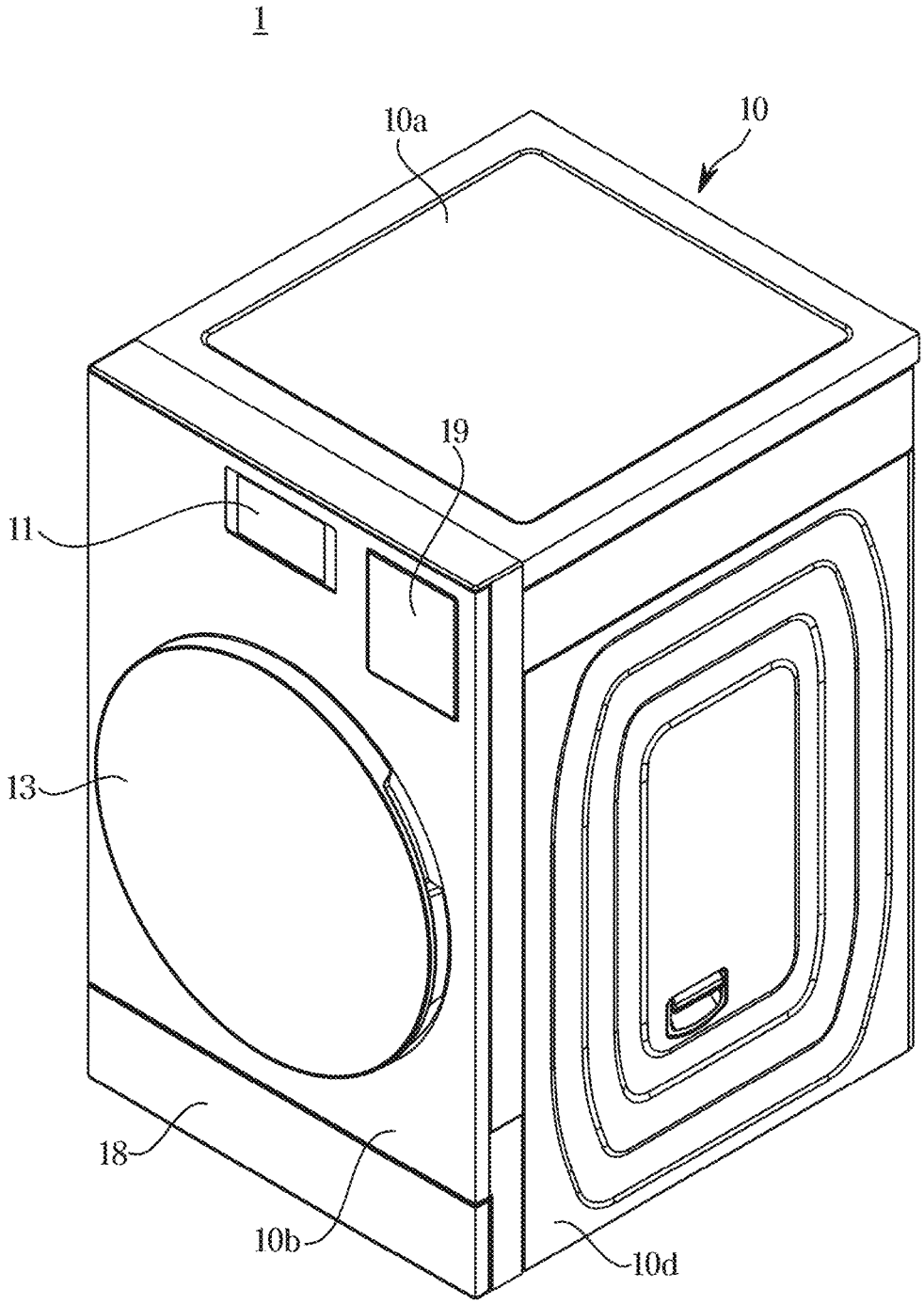
FIG. 1 is a perspective view illustrating a clothes care apparatus according to various embodiments.

Various embodiments and the terms used therein are not intended to limit the technology disclosed herein to specific forms, and the disclosure should be understood to include various modifications, equivalents, and/or alternatives to the corresponding embodiments.

In describing the drawings, similar reference numerals may be used to designate similar elements.

A singular expression may include a plural expression unless otherwise indicated herein or clearly contradicted by context.

The expressions "A or B," "at least one of A or/and B," or "one or more of A or/and B," A, B or C," "at least one of A, B or/and C," or "one or more of A, B or/and C," and the like used herein may include any and all combinations of one or more of the associated listed items.

The term "and/or" includes a plurality of combinations of relevant items or any one item among a plurality of relevant items.

Herein, the expressions "a first", "a second", "the first", "the second", etc., may simply be used to distinguish an element from other elements, but is not limited to another aspect (e.g., importance or order) of elements.

When an element (e.g., a first element) is referred to as being "(functionally or communicatively) coupled," or "connected" to another element (e.g., a second element), the first element may be connected to the second element, directly (e.g., wired), wirelessly, or through a third element.

The terms "including", "having", and the like are used to specify features, numbers, steps, operations, elements, components, or combinations thereof, but do not preclude the presence or addition of one or more of the features, elements, steps, operations, elements, components, or combinations thereof.

When an element is said to be "connected", "coupled", "supported" or "contacted" with another element, this includes not only when elements are directly connected, coupled, supported or contacted, but also when elements are indirectly connected, coupled, supported or contacted through a third element.

Throughout the disclosure, when an element is "on" another element, this includes not only when the element is in contact with the other element, but also when there is another element between the two elements.

A washing machine according to various embodiments may perform washing, rinsing, spin-drying, and drying processes. The washing machine is an example of a clothes care apparatus, and the clothes care apparatus is a concept including a device capable of washing clothes (objects to be washed, and objects to be dried), a device capable of drying clothes, and a device capable of washing and drying clothes, but is not limited thereto.

The washing machine according to various embodiments may include a top-loading washing machine in which a laundry inlet for inserting or withdrawing laundry is provided to face upward, or a front-loading washing machine in which a laundry inlet is provided to face forward. The washing machine according to various embodiments may include a washing machine that is in a loading type other than the top-loading washing machine and the front-loading washing machine.

In the top-loading washing machine, laundry may be washed using water current generated by a rotating body such as a pulsator. In the front-loading washing machine, laundry may be washed by repeatedly lifting and lowering laundry by rotating a drum. The front-loading washing machine may include a drying combined washing machine capable of drying laundry stored in a drum. The drying combined washing machine may include a hot air supply device for supplying high-temperature air into the drum and a condensing device for removing moisture from air discharged from the drum. For example, the drying combined washing machine may include a heat pump device. The washing machine according to various embodiments may include a washing machine using a washing method other than the above-described washing method.

The washing machine according to various embodiments may include a housing accommodating various components therein. The housing may be provided in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be seen.

The washing machine may include a tub arranged inside the housing to store water. The tub may be formed in a substantially cylindrical shape with a tub opening formed at one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum provided to accommodate laundry.

The drum may be disposed inside the tub in such a way that a drum opening provided at one side of the drum corresponds to the laundry inlet and the tub opening. Laundry may pass through the laundry inlet, the tub opening, and the drum opening, sequentially and then be accommodated in the drum or withdrawn from the drum.

The drum may perform each operation according to washing, rinsing, and/or spin-drying while rotating inside the tub. A plurality of through holes may be formed in a cylindrical wall of the drum to allow water stored in the tub to be introduced into or to be discharged from the drum.

The washing machine may include a driving device configured to rotate the drum. The driving device may include a drive motor and a rotating shaft for transmitting a driving force generated by the drive motor to the drum. The rotating shaft may penetrate the tub to be connected to the drum.

The driving device may perform respective operations according to washing, rinsing, and/or spin-drying, or drying processes by rotating the drum in a forward or reverse direction.

The washing machine may include a water supply device configured to supply water to the tub. The water supply device may include a water supply pipe and a water supply valve disposed in the water supply pipe. The water supply pipe may be connected to an external water supply source. The water supply pipe may extend from an external water supply source to a detergent supply device and/or the tub. Water may be supplied to the tub through the detergent supply device. Water may be supplied to the tub without passing through the detergent supply device.

The water supply valve may open or close the water supply pipe in response to an electrical signal of a controller. The water supply valve may allow or block the supply of water to the tub from an external water supply source. The water supply valve may include a solenoid valve configured to open and close in response to an electrical signal.

The washing machine may include the detergent supply device configured to supply detergent to the tub. The detergent supply device may include a manual detergent supply device that requires a user to input detergent to be used for each washing, and an automatic detergent supply device that stores a large amount of detergent and automatically inputs a predetermined amount of detergent during washing. The detergent supply device may include a detergent box for storing detergent. The detergent supply device may be configured to supply detergent into the tub during a water supply process. Water supplied through the water supply pipe may be mixed with detergent via the detergent supply device. Water mixed with detergent may be supplied into the tub. Detergent is used as a term including detergent for pre-washing, detergent for main washing, fabric softener, bleach, etc., and the detergent box may be partitioned into a storage region for the pre-washing detergent, a storage region for the main washing detergent, a storage region for the fabric softener, and a storage region for the bleach.

The washing machine may include a drainage device configured to discharge water contained in the tub to the outside. The drainage device may include a drain pipe extending from a bottom of the tub to the outside of the housing, a drain valve disposed on the drain pipe to open and close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal.

The at least one input interface may include a power button, an operation button, a course selection dial (or a course selection button), and a washing/rinsing/spin-drying setting button. The at least one input interface may include a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user.

For example, the at least one output interface may transmit information related to a washing course, operation time of the washing machine, and washing/rinsing/spin-drying settings to the user. Information about the operation of the washing machine may be output through a screen, an indicator, or voice. The at least one output interface may include, for example, a Liquid Crystal Display (LCD) panel, a Light Emitting Diode (LED) panel, or a speaker.

The washing machine may include a communication module including various communication circuitry for wired and/or wireless communication with an external device.

The communication module may include at least one of a short-range wireless communication module and a long-range wireless communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between external devices, and support the performance of the communication through the established communication channel. According to an embodiment, the communication module may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, and a server on a mobile communication network.

According to an embodiment, the communication module may communicate with an external device such as a server, a user device and other home appliances through an access point (AP). The access point (AP) may connect a local area network (LAN), to which a washing machine or a user device is connected, to a wide area network (WAN) to which a server is connected. The washing machine or the user device may be connected to the server through the wide area network (WAN). The controller may control various components of the washing machine (e.g., the drive motor, and the water supply valve). The controller may include various circuitry configured to control various components of the washing machine to perform at least one operation including water supply, washing, rinsing, and/or spin-drying according to a user input. For example, the controller may control the drive motor to adjust the rotational speed of the drum or control the water supply valve of the water supply device to supply water to the tub.

The controller may include hardware such as a CPU and/or memory, and software such as a control program. For example, the controller may include at least one memory for storing an algorithm and program-type data for controlling the operation of components in the washing machine, and at least one processor configured to perform the above-mentioned operation using the data stored in the at least one memory. The processor according to an embodiment of the disclosure may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Hereinafter, the clothes care apparatus according to various embodiments of the disclosure is described in greater detail with reference to the accompanying drawings. Hereinafter, although the disclosure is described based on a drying combined washing machine, the clothes care apparatus according to various embodiments is not limited thereto and is applicable to a variety of apparatuses for treating and/or caring clothes.

Throughout the disclosure, the directions of front, rear, upper, lower, left, and right are collectively referred to based on the directions shown in FIG. 1. In FIG. 1, x-axis, y-axis, and z-axis directions perpendicular to each other are shown, where the x-axis direction, the y-axis direction, and the z-axis direction refer to the front, the left, and the upper direction, respectively.

Figure 2:
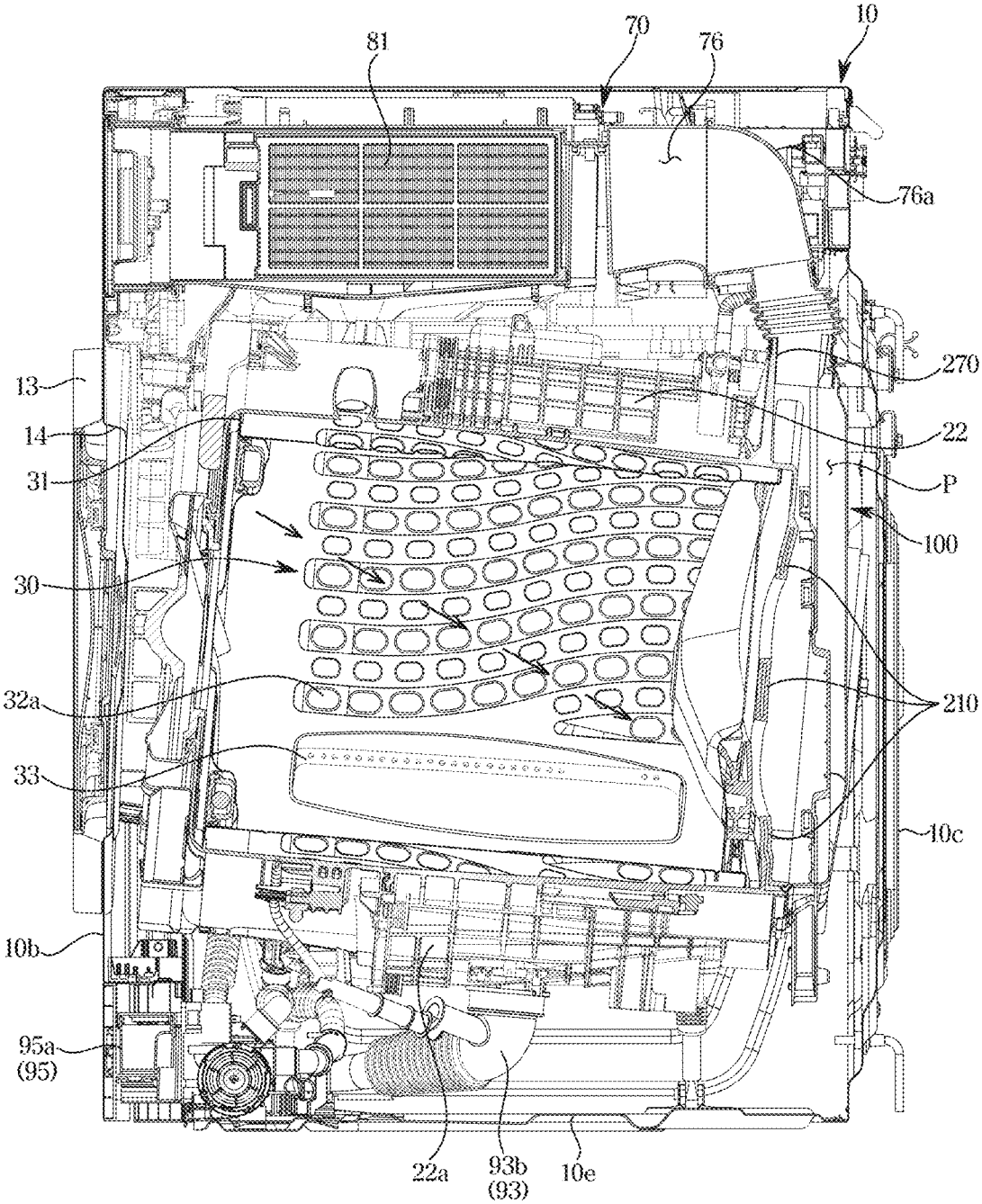
FIG. 2 is a cross-sectional view of a clothes care apparatus according to various embodiments.
Figure 3:
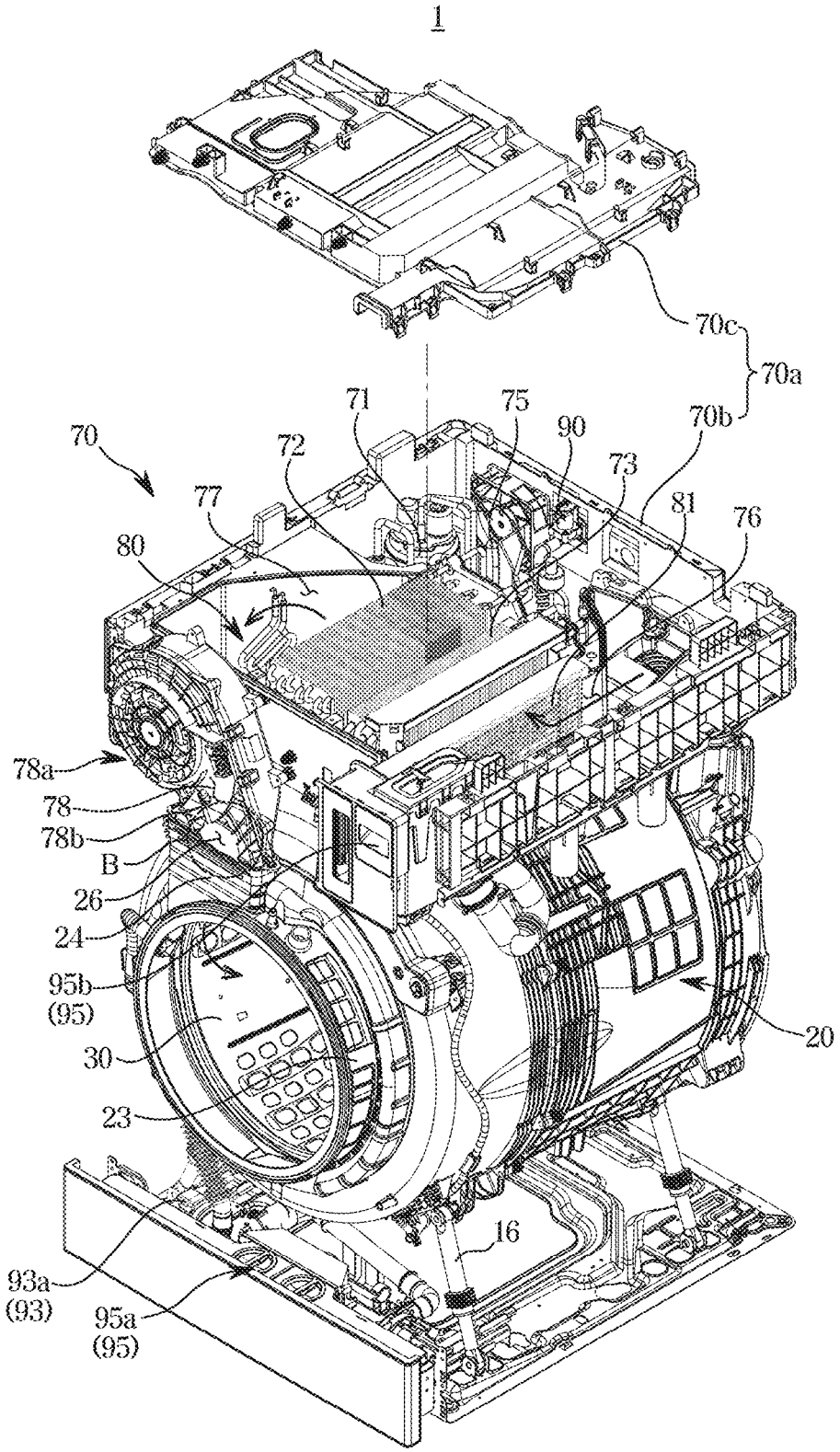
FIG. 3 is an exploded perspective view illustrating a portion of components disposed in a clothes care apparatus according to various embodiments.
Figure 4:
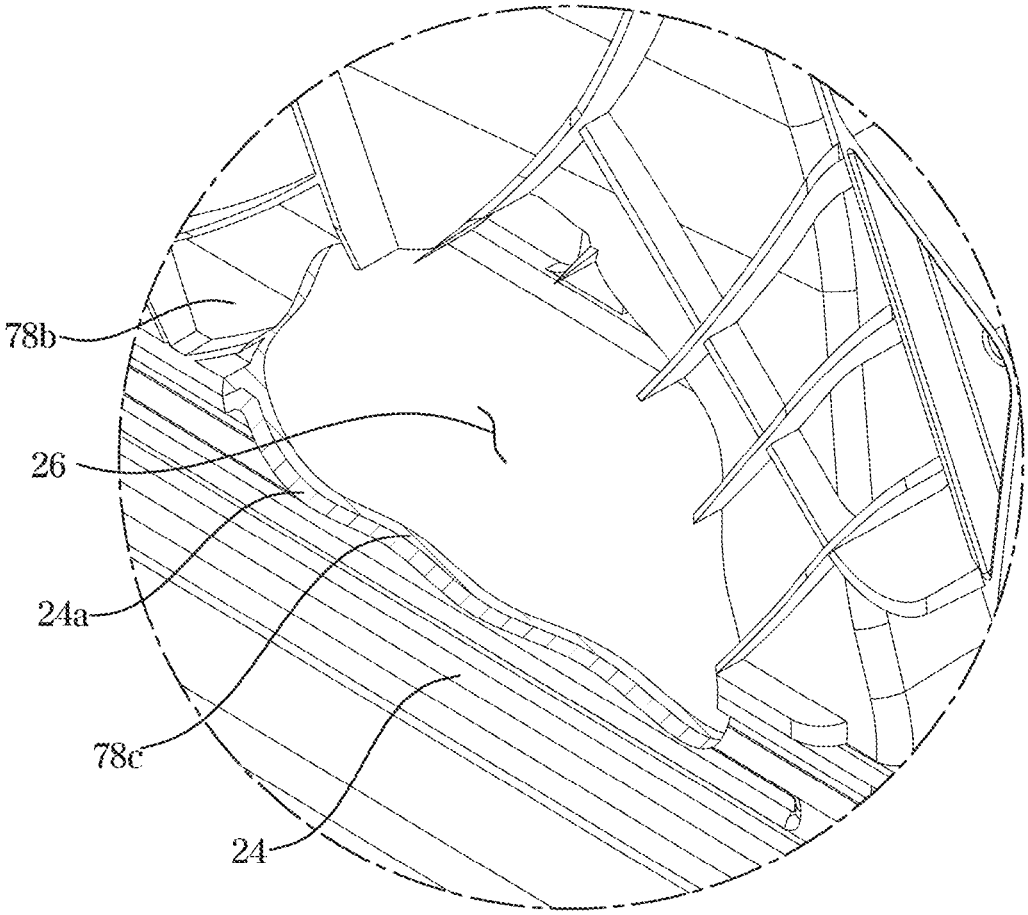
FIG. 4 is a diagram illustrating an enlarged view of B of FIG. 3 according to various embodiments.
Figure 5:
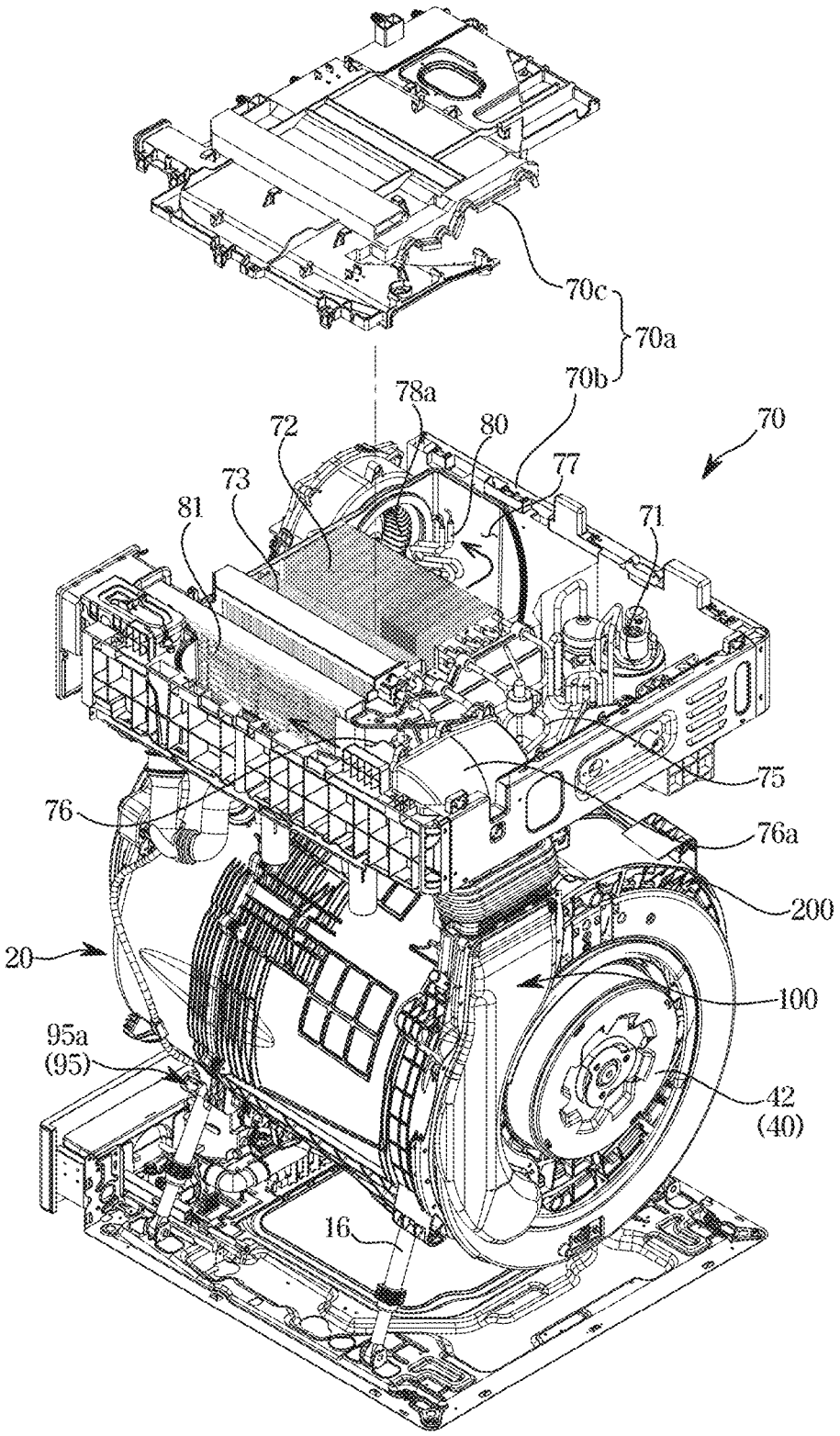
FIG. 5 is an exploded perspective view illustrating a portion of components disposed in a clothes care apparatus in a direction different from FIG. 3 according to various embodiments.
Figure 6:
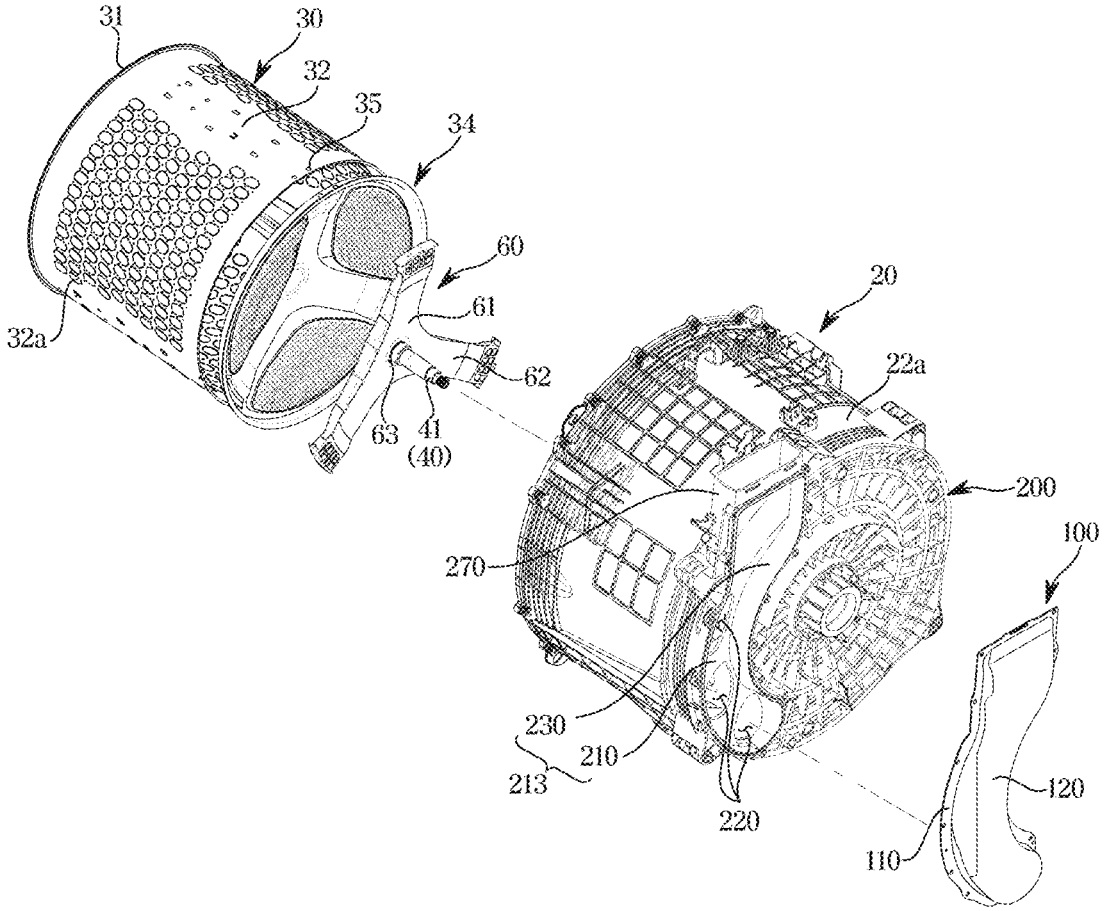
FIG. 6 is an exploded perspective view illustrating a portion of components of a clothes care apparatus according to various embodiments

FIG. 1 is a perspective view illustrating a clothes care apparatus according to various embodiments. FIG. 2 is a cross-sectional view of a clothes care apparatus according to various embodiments. FIG. 3 is an exploded perspective view illustrating a portion of components disposed in a clothes care apparatus according to various embodiments. FIG. 4 is a diagram illustrating an enlarged view of B of FIG. 3 according to various embodiments. FIG. 5 is an exploded perspective view illustrating a portion of components disposed in a clothes care apparatus in a direction different from FIG. 3 according to various embodiments. FIG. 6 is an exploded perspective view illustrating a portion of components of the clothes care apparatus according to various embodiments.

Referring to FIG. 1 to FIG. 6 (e.g., including FIGS. 1, 2, 3, 4, 5 and 6), a clothes care apparatus 1 according to an embodiment may be a drying combined washing machine. The clothes care apparatus 1 includes a housing 10 forming an exterior, a tub 20 accommodating water that may be used in a washing or rinsing process, a drum 30 accommodating laundry, and a drive motor 42 rotating the drum 30.

The housing 10 may be provided in a substantially hexahedral shape. In other words, the housing 10 may be in a box shape. The housing 10 may include frames 10*a*, 10*b*, 10*c*, 10*d*, and 10*e*, e.g., an upper frame 10*a* forming an upper surface of the housing 10, a front frame 10*b* and a rear frame 10*c* forming a front surface and a rear surface of the housing 10, respectively, and a side frame 10*d* and a lower frame 10*e* connecting the front frame 10*b* and the rear frame 10*c* and forming a side surface and a lower surface of the housing 10.

A laundry inlet 14 may be formed in the front frame 10*b* of the housing 10 to insert or withdraw laundry into the drum 30. The laundry inlet 14 may be opened and closed by a door 13 installed on the front frame 10*b* of the housing 10.

The clothes care apparatus 1 may include the door 13 for opening and closing the laundry inlet 14. The door 13 may be rotatably mounted to the housing 10 by a hinge. At least a portion of the door 13 may be transparent or translucent to allow the inside of the housing 10 to be seen. For example, the door 13 may include tempered glass.

The clothes care apparatus 1 may include a lower door 18 configured to provide access to a lower detergent supply device 95*a*. The clothes care apparatus 1 may include an upper door 19 configured to provide access to an upper detergent supply device 95*b* and a filter 81.

A control panel 11 may be provided on an upper portion of the front frame 10*b* of the housing 10 to control an operation of the clothes care apparatus 1. The control panel 11 may provide a user interface for interaction between a user and the clothes care apparatus 1. The control panel 11 may include an inputter for inputting an operation of the clothes care apparatus 1, and a display for displaying various information about the clothes care apparatus 1. For example, the control panel 11 may include a display panel capable of touch input. However, the disclosure is not limited thereto, and the control panel may include various types of inputters and displays.

The clothes care apparatus 1 may include the tub 20 disposed inside the housing 10 to store water. The tub 20 may be provided in a substantially cylindrical shape with a tub opening formed at one side thereof, and may be disposed inside the housing 10 to allow a tub opening to correspond to the laundry inlet 14. The tub opening may face approximately forward.

The tub 20 may include a tub body 22*a* corresponding to a side surface of cylinder. The tub body 22*a* may be provided in a cylindrical shape with the front and rear sides open, respectively. The tub opening may be provided at a front of the tub body 22*a*. The tub opening may have a diameter similar to or smaller than a diameter of the tub body 22*a*. The tub 20 may include a tub back 200 forming a rear surface of the tub 20. The tub back 200 may be provided at a rear (side) of the tub body 22*a*. The tub back 200 may cover the rear side of the tub body 22*a*. The tub back 200 may have a size and shape corresponding to the open rear surface of the tub body 22*a* so as to cover the open rear surface of the tub body 22*a*. The tub back 200 may have a diameter similar/corresponding to the diameter of the tub body 22*a*.

The tub 20 may be connected to the housing 10 by a damper 16. The damper 16 may absorb vibration generated when the drum 30 rotates, thereby reducing the vibration transmitted to the housing 10.

The clothes care apparatus 1 may include the drum 30 to accommodate laundry. The drum 30 may be in a cylindrical shape. The drum 30 may be disposed inside the housing 10.

The drum 30 may be rotatable by receiving power from a driving device 40. The driving device 40 rotating the drum 30 is described later.

The drum 30 may rotate inside the tub 20 and perform each operation according to washing, rinsing, and/or spin-drying processes. A plurality of through holes 32*a* may be formed in a cylindrical wall of the drum 30 to allow water stored in the tub 20 to be introduced into the drum 30 or to be discharged from the drum 30.

The clothes care apparatus 1 may include a water supply device 90 to supply water to the tub 20. The water supply device 90 may be disposed above the tub 20. The water supply device 90 may be disposed behind a drying device (e.g., including a heat pump module) 70.

The clothes care apparatus 1 may include a detergent supply device 95 for supplying detergent to the tub 20. The detergent supply device 95 may include the upper detergent supply device 95*b* and the lower detergent supply device 95*a*. The upper detergent supply device 95*b* may be disposed above the tub 20. The lower detergent supply device 95*a* may be disposed below the tub 20. The term "detergent" may include, for example, and without limitation, detergent for pre-washing, detergent for main washing, fabric softener, bleach, and the like.

The clothes care apparatus 1 may include a drainage device 93 to discharge water accommodated in the tub 20 to the outside. The drainage device 93 may be disposed below the tub 20. The drainage device 93 may include a drain pump 93*a* for discharging the water in the tub 20 to the outside of the housing 10, a connecting hose 93*b* connecting the tub 20 and the drain pump 93*a* to allow the water in the tub 20 to be introduced into the drain pump 93*a*, and a drain hose for guiding the water pumped by the drain pump 93*a* to the outside of the housing 10.

The tub 20 may be supported by the damper 16. The damper 16 may connect the lower frame 10*e* of the housing 10 and an outer surface of the tub 20. The damper 16 may be located on the upper, left and right sides of the housing 10 in addition to the lower frame, to support the tub 20.

The water supply device 90 may be disposed above the tub 20 to supply wash water to the tub 20. The water supply device 90 may be disposed behind the drying device 70.

The drum 30 may include a drum body 32, a drum front 31, and a drum back 34.

The drum body 32 may be formed in a hollow cylindrical shape with open front and rear ends. The plurality of through holes 32*a* may be formed in the cylindrical drum body 32 to allow the water stored in the tub 20 to be introduced into the drum 30 or to be discharged from the drum 30. At least one lifter 33 may be installed on an inner circumferential surface of the drum body 32 to lift and drop laundry when the drum 30 rotates.

The drum front 31 may be disposed at a front end of the drum body 32, and the drum back 34 may be disposed at a rear end of the drum body 32.

A coupling hole 35 may be formed on a side surface of the drum body 32. The coupling hole 35 may be formed at the rear end of the drum body 32 to allow the drum back 34 to be coupled. A plurality of coupling holes 35 may be formed. The coupling holes 35 may secure a flange shaft 60 installed in the drum back 34. The coupling holes 35 may be formed to correspond to the flange shaft 60. The coupling holes 35 may be spaced apart at regular intervals along the circumferential direction of the drum body 32 to correspond to the flange shaft 60.

The drum front 31 may correspond to a front end opening of the drum body 32. The drum back 34 may correspond to a rear end opening of the drum body 32.

The drum back 34 may be formed in a disk shape to close the rear end opening of the drum body 32. In an embodiment of the disclosure, a plurality of holes may be formed in the drum back 34 to allow air to easily pass from the inside of the drum to the outside.

The clothes care apparatus 1 may include the driving device 40 to rotate the drum 30. The driving device 40 may include the drive motor 42, and a rotating shaft 41 connected to the drum 30 to transmit a driving force generated by the drive motor 42 to the drum 30. The rotating shaft 41 for transmitting power of the drive motor 42 may be connected to the drum back 34 of the drum 30. The drum 30 may rotate in the tub 20 by a rotational force transmitted through the rotating shaft 41.

The drive motor 42 may be disposed outside the tub 20. The drive motor 42 may be connected to the drum 30 through the rotating shaft 41. The rotating shaft 41 may penetrate the tub back 200 of the tub 20 and may be rotatably supported by a bearing 52 and a bearing housing 51.

The drive motor 42 may include a stator fixed to an outside of the tub back 200, and a rotor that is rotatable and connected to the rotating shaft 41. The rotor may electromagnetically interact with the stator to convert a rotating electrical force into a mechanical rotational force. Rotation of the rotor may be transmitted to the drum 30 through the rotating shaft 41.

The drum back 34 may be connected to the rotating shaft 41 through the flange shaft 60. The flange shaft 60 may transmit the power of the drive motor 42.

The flange shaft 60 may include a hub portion 61 disposed at a center of the drum back 34, and a plurality of flange portions 62 extending radially from the hub portion 61. A shaft coupling portion 63 may be formed at a center of the hub portion 61 so as to install the rotating shaft 41.

The plurality of flange portions 62 may be formed at intervals of approximately 120 degrees around the hub portion 61. The plurality of flange portions 62 may be formed to correspond to a diameter of the drum back 34. A plurality of fastening holes 64 may be formed at one end of each of the flange portions 62. The plurality of fastening holes 64 may be formed to correspond to the coupling holes 35 of the drum 30. In an embodiment of the disclosure, although two fastening holes formed in one flange portion are shown as an example, the disclosure is not limited thereto. For example, the arrangement and the number of fastening holes may vary depending on a size and shape of the drum and flange portion.

The rotating shaft 41 may be disposed between the drum 30 and the drive motor 42. One end of the rotating shaft 41 may be connected to the drum back 34, and the other end of the rotating shaft 41 may extend to the outside of the tub back 200. When the drive motor 42 rotates the rotating shaft 41, the drum 30 connected to the rotating shaft 41 may rotate around the rotating shaft 41.

The bearing housing 51 is installed in the tub back 200 to rotatably support the rotating shaft 41. The bearing housing 51 may be made of aluminum alloy. For example, the bearing housing 51 may be made by Aluminum Die Casting (ALDC). However, the disclosure is not limited thereto, and the bearing housing 51 may be made of stainless steel. The bearing housing 51 is sufficient as long as it is made of a material stronger than a material forming the tub 20.

The bearing housing 51 may be inserted into the tub back 200 when the tub 20 is injection molded. For example, the tub 20 may be formed by inserting the bearing housing 51 into a mold (not shown) for forming the tub 20, and then injecting molten resin into the mold. Through the above, the tub 20 with the bearing housing 51 inserted in the tub back 200 may be formed integrally.

The bearings 52 (see, e.g., FIG. 8) may be installed between the bearing housing 51 and the rotating shaft 41 to allow the rotating shaft 41 to rotate smoothly.

The clothes care apparatus 1 may include the drying device 70 for drying laundry accommodated in the drum 30. The drying device 70 may heat air and supply the heated air to the inside of the tub 20. The drying device 70 may dry and heat the air discharged from the tub 20, and circulate the dried and heated air inside the tub 20 to dry the laundry in the drum 30. The drying device 70 according to various embodiments may be disposed above the tub 20.

The drying device 70 may include a drying case 70*a* in which a heat pump for drying air may be installed. The drying case 70*a* may include a drying base 70*b*, and a drying cover 70*c* coupled to the drying base 70*b* to form a flow path through which air may pass. The drying cover 70*c* may cover an open upper surface of the drying base 70*b*.

The drying device 70 according to various embodiments may be configured as a heat pump type. The drying device 70 may include a compressor 71, a condenser 72, an evaporator 73, an expansion valve, and a refrigerant pipe 75 for allowing a refrigerant to circulate for heat exchange. The compressor 71, the condenser 72, the evaporator 73, and the like, that comprise the heat pump may be disposed in the drying case 70A. For example, the drying device 70 may be mounted to the clothes care apparatus 1 as a single module.

The compressor 71 compresses the refrigerant, and the compressed high-temperature and high-pressure refrigerant may move to the condenser 72. The condenser 72 may cool the refrigerant to heat the surrounding air. The heated air may flow into the drum 30 to dry laundry.

The refrigerant expanded through the expansion valve may absorb heat from the evaporator 73 and cool the surrounding air. That is, the evaporator 73 may remove moisture by cooling the high-temperature and humid air that has passed through the inside of the drum 30. The air from which moisture has been removed may pass through the condenser 72, and may be heated again while exchanging heat with the refrigerant in the condenser 72. That is, the condenser 72 may heat the air that has passed through the evaporator 73. The condenser 72 and evaporator 73 may be referred to as a heat exchanger.

In addition, the drying device 70 may further include a heater 80 in addition to the heat pump to increase a drying efficiency. However, the disclosure is not limited thereto, and the drying device 70 may be configured as a heater type including only the heater 80, rather than as a heat pump type.

The heater 80 may heat the air introduced into the drying device 70. The heater 80 may be disposed in a heating flow path 77. The heater 80 may be disposed downstream of the condenser 72. In addition, the heater 80 may be provided in a small size to minimize/reduce flow path resistance. For example, the heater 80 may be a sheath heater.

An inlet flow path 76 into which the air discharged from the tub 20 flows may be formed in the drying device 70. The heating flow path 77 may be formed in the drying device 70 for heat exchange of the air introduced into the drying device 70 through the inlet flow path 76. The drying device 70 may be provided with a supply flow path 78 through which the air heat-exchanged while passing through the heating flow path 77 is supplied to the tub 20. The inlet flow path 76 is provided to allow the air passing through the inside of the tub 20 to flow into the drying device 70. The inlet flow path 76 may be disposed above the tub 20. The inlet flow path 76 may communicate with an exhaust flow path P formed at the rear of the tub 20.

The drying device 70 may include an inlet guide 76*a* connected to the tub 20. The inlet guide 76*a* may guide the air discharged from the tub 20 to the inlet flow path 76. The inlet flow path 76 may communicate with the exhaust flow path P formed in the tub 20 through the inlet guide 76*a*. The air that has passed through the exhaust flow path P may flow into the inlet flow path 76 of the drying device 70 through the inlet guide 76*a*.

A filter 81 may be disposed in the inlet flow path 76 to filter out foreign substances, such as lint, contained in the air flowing in from the tub 20 through the exhaust flow path P. The air flowing into the inlet flow path 76 may flow into the heating flow path 77 through the filter 81.

The condenser 72 and the evaporator 73 may be disposed in the heating flow path 77. Because the introduced air has already passed through the inside of the tub 20, the introduced air may be high-temperature and humid. The high-temperature and humid air may be cooled in the evaporator 73 disposed in the heating flow path 77 to remove moisture. Afterwards, the air may be heated again while passing through the condenser 72.

The supply flow path 78 may supply the air, heated while passing through the condenser 72, back to the tub 20. The supply flow path 78 may communicate with the heating flow path 77 and extend downward to discharge the heated air toward an air inlet 26 of the tub 20.

The supply flow path 78 may include a blower fan 78*a* to allow air to flow into the tub 20. According to an embodiment, the blower fan 78*a* may be disposed in the supply flow path 78. The blower fan 78*a* may cause air from the heating flow path 77 and the supply flow path 78 to flow into the drum 30. For example, the blower fan 78*a* may include a sirocco fan.

In the clothes care apparatus 1 according to an embodiment, the supply flow path 78 may be formed to allow air to move downward from below the blower fan 78*a* disposed at the front of the drying base 70*b*. The supply flow path 78 may extend downward from the blower fan 78*a* and connect the blower fan 78*a* and the air inlet 26 of the tub 20. The supply flow path 78 extends below the blower fan 78*a*, thereby minimizing/reducing the front-to-back volume. In other words, the volume of the clothes care apparatus 1 in the front-back direction due to the supply flow path 78 may be prevented or minimized and/or reduced from being increased.

With the above configuration, the air that has passed through the heating flow path 77 may be introduced into the supply flow path 78 by the blower fan 78*a*, move along the supply flow path 78 downwardly to the blower fan 78*a*, and then may be discharged into the tub 20 through the air inlet 26.

Referring to FIG. 3, the washing machine according to an embodiment may include a diaphragm 23 connecting a tub opening of the tub 20 and the laundry inlet 14 of the housing 10. The diaphragm 23 may connect the laundry inlet 14 and the tub opening. The diaphragm 23 may prevent and/or reduce/inhibit the laundry put into the laundry inlet 14 from falling between the housing 10 and the tub 20, and may function to connect a front end of the tub 20 and the housing 10 regardless of vibrations occurring during a washing process. To this end, the diaphragm 23 may be formed of an elastic material. For example, the diaphragm 23 may include a plastic material such as rubber or Thermo Plastic Elastomer (TPE).

Referring to FIG. 4, in the washing machine according to an embodiment, the diaphragm 23 may include a duct portion 24 provided to be connected to a supply duct 78*b* forming the supply flow path 78. The duct portion 24 may extend upward from a side of the diaphragm 23 having a cylindrical shape with both sides open. A flow path may be formed inside the duct portion 24 to allow air to flow. The duct portion 24 may be formed adjacent to an upper end of the diaphragm 23. The duct portion 24 may be formed integrally with the diaphragm 23 and have the same material. Alternatively, the duct portion 24 may be provided separately from the diaphragm 23 and may be coupled to the diaphragm 23. In addition, the duct portion 24 may be provided separately from the diaphragm 23 and the tub 20 and may be coupled to the tub 20. The duct portion 24 may be formed integrally with the tub 20.

An opening 24*a* may be formed at one end of the duct portion 24. The opening 24*a* may refer to the air inlet 26 described above. An outlet 78*c* may be formed at one end of the supply duct 78*b* forming the supply flow path 78. The opening 24*a* and the outlet 78*c* may be of corresponding sizes and shapes. When the duct portion 24 and the supply duct 78*b* are connected, the opening 24*a* and the outlet 78*c* may be substantially the same hole. When the duct portion 24 and the supply duct 78*b* are connected, the opening 24*a* and the outlet 78*c* may each be the air inlet 26.

The clothes care apparatus 1 may include the exhaust flow path P to allow the air discharged from the inside of the tub 20 to flow to the drying device 70. The air that has passed through the exhaust flow path P may flow into the inlet flow path 76 of the drying device 70. For example, the exhaust flow path P may be provided at the rear of the tub 20.

The air may circulate through the inside of the tub 20 and the drying device 70 by the exhaust flow path P, the inlet flow path 76, the heating flow path 77, and the supply flow path 78.

In the clothes care apparatus 1 according to an embodiment of the disclosure, the air discharged to the rear of the tub 20 may flow into the inlet flow path 76 of the drying device 70, located above the tub 20, through the exhaust flow path P, then sequentially pass through the heating flow path 77 and the supply flow path 78, and then be supplied back into the inside of the tub 20.

A tub exhaust port 220 may be formed in the tub back 200 to allow the air in the tub 20 to be discharged to the rear of the tub 20. The air discharged through the tub exhaust port 220 may flow into the inlet flow path 76 along the exhaust flow path P.

In the clothes care apparatus 1 according to an embodiment, the exhaust flow path P may be formed by coupling a duct cover 100 to the tub back 200. The exhaust flow path P may be formed by coupling the duct cover 100 to a tub duct 213, which will be described later.

The tub back 200 according to an embodiment may include reinforcing ribs 201 (see, e.g., FIG. 7) formed on a rear surface of the tub back 200, and the tub duct 213 formed on the rear surface of the tub back 200. A front surface of the tub back 200 may refer to one side of the tub back 200 disposed inside the tub 20, and the rear surface of the tub back 200 may refer to another side of the tub back 200 disposed outside the tub 20. In addition, the front surface of the tub back 200 may refer to as an inner surface of the tub back 200, and the rear surface of the tub back 200 may refer to as an outer surface of the tub back 200.

The reinforcing ribs 201 may be formed to reinforce a rigidity of the tub back 200. The reinforcing ribs 201 may protrude rearward from the rear surface of the tub back 200.

The tub duct 213 may include a recess portion 210 and a partition rib 230. The recess portion 210 may be formed around the tub exhaust port 220, and may refer to a portion where the reinforcing ribs 201 are not formed or a portion that is recessed forward than rear ends of the reinforcing ribs 201. The recess portion 210 may be formed to have a narrower front and rear width than a portion where the reinforcing ribs 201 are formed in the tub back 200. That is, the front and rear width of the recess portion 210 may be smaller than the front and rear width of the portion where the reinforcing ribs 201 are formed. Accordingly, the recess portion 210 may be recessed from the tub back 200. In other words, the recess portion 210 may be formed such that a portion of the tub back 200 is formed in a stepped manner. In addition, a portion of the rear surface of the tub back 200 where the reinforcing ribs 201 are not formed may be referred to as the recess portion 210. The partition rib 230 may refer to a protrusion formed along an edge of the recess portion 210. The partition rib 230 may protrude from the edge of the recess portion 210 to the rear of the tub back 200. The partition rib 230 may form a side wall of the exhaust flow path P. A front-to-back width of the partition rib 230 may be greater than or equal to that of the reinforcing rib 201. The front-to-back width of the partition rib 230 may be referred to as a height of the partition rib 230. The front-to-back width of the reinforcing rib 201 may be referred to as a height of the reinforcing rib 201.

The air heated in the drying device 70 may flow into the tub 20, and then be supplied into the drum 30. In this instance, an area where the heated air supplied into the drum 30 comes into contact with the laundry is required to be secured. The longer the distance and time for which the heated air flows in the drum 30, the more the heated air may come into contact with the laundry. Accordingly, the tub exhaust port 220 may be formed at a position opposite to the air inlet 26 through which the air heated in the drying device 70 flows into the tub 20.

The air inlet 26 through which the air heated in the drying device 70 flows into the tub 20 and the tub exhaust port 220 through which the air in the tub 20 is discharged may be located as far apart as possible. To this end, the air inlet 26 and the tub exhaust port 220 may be located diagonally when the tub 20 is viewed from the front or rear.

For example, in a case where the air inlet 26 is formed at an upper right front side of the tub 20 or at a position adjacent to the upper right front side of the tub 20, the tub exhaust port 220 may be formed at a lower left side of the tub back 200, or at a position adjacent to the lower left side of the tub back 200. In this case, the heated air moves from the front upper right side of the tub 20 toward the lower left side of the tub back 200, and thus the heated air may move in a similar direction inside the drum 30 disposed in the tub 20. That is, the heated air may move diagonally from the upper right front side of the drum 30 toward the lower left rear side of the drum 30. As a result, a movement path of the heated air in the drum 30 may be as long as possible. As the movement path of the heated air increases, the heated air may come into contact with the laundry in the drum 30 over a large area for a long time, and thus a drying efficiency of the clothes care apparatus 1 may be improved.

However, the disclosure is not limited thereto, and the air inlet 26 and the tub exhaust port 220 may be arranged in different positions depending on an area of each of the air inlet 26 and the tub exhaust port 220 and/or an air volume of the blower fan 78*a*.

The exhaust flow path P may be formed by the duct cover 100 covering one open side of the recess portion 210. The exhaust flow path P may be a single flow path formed by the recess portion 210 and the duct cover 100 together.

The duct cover 100 may be coupled to the tub back 200. The duct cover 100 may form the exhaust flow path P through which the air discharged through the tub exhaust port 220 flows to the drying device 70. Specifically, the duct cover 100 may be coupled to cover the one open side of the recess portion 210 formed in the tub back 200. A method of coupling the duct cover 100 to the tub back 200 will be described later.

The tub 20 may include a duct connection portion 270 protruding outwardly from the tub body 22*a* in a radial direction of the tub body 22*a*. For example, the duct connection portion 270 may protrude upward from a rear end of the tub body 22*a*. However, the disclosure is not limited thereto, and the duct connection portion 270 may be positioned in various manners depending on the location of the drying device 70.

The duct connection portion 270 may connect the inlet guide 76*a* of the drying device 70 and the tub duct 213. The duct connection portion 270 may form a portion of the exhaust flow path P together with the recess portion 210, the partition rib 230, and the duct cover 100.

The duct cover 100 may cover the tub duct 213 and the duct connection portion 270. The duct cover 100 may cover both an open side of the tub duct 213 and an open rear side of the duct connection portion 270. The duct cover 100 covers the recess portion 210 and the duct connection portion 270, thereby forming the exhaust flow path P. Because the exhaust flow path P is connected to the inlet flow path 76, the air flowing into the exhaust flow path P through the tub exhaust port 220, formed in the tub back 200, may move upward along the exhaust flow path P, and may flow into the drying device 70 through the inlet flow path 76.

Although not illustrated, the duct connection portion 270 may be provided in a rectangular parallelepiped shape with only an upper surface through which air is discharged open and the rear surface closed. In this case, the duct cover 100 may cover only the tub duct 213.

Figure 7:
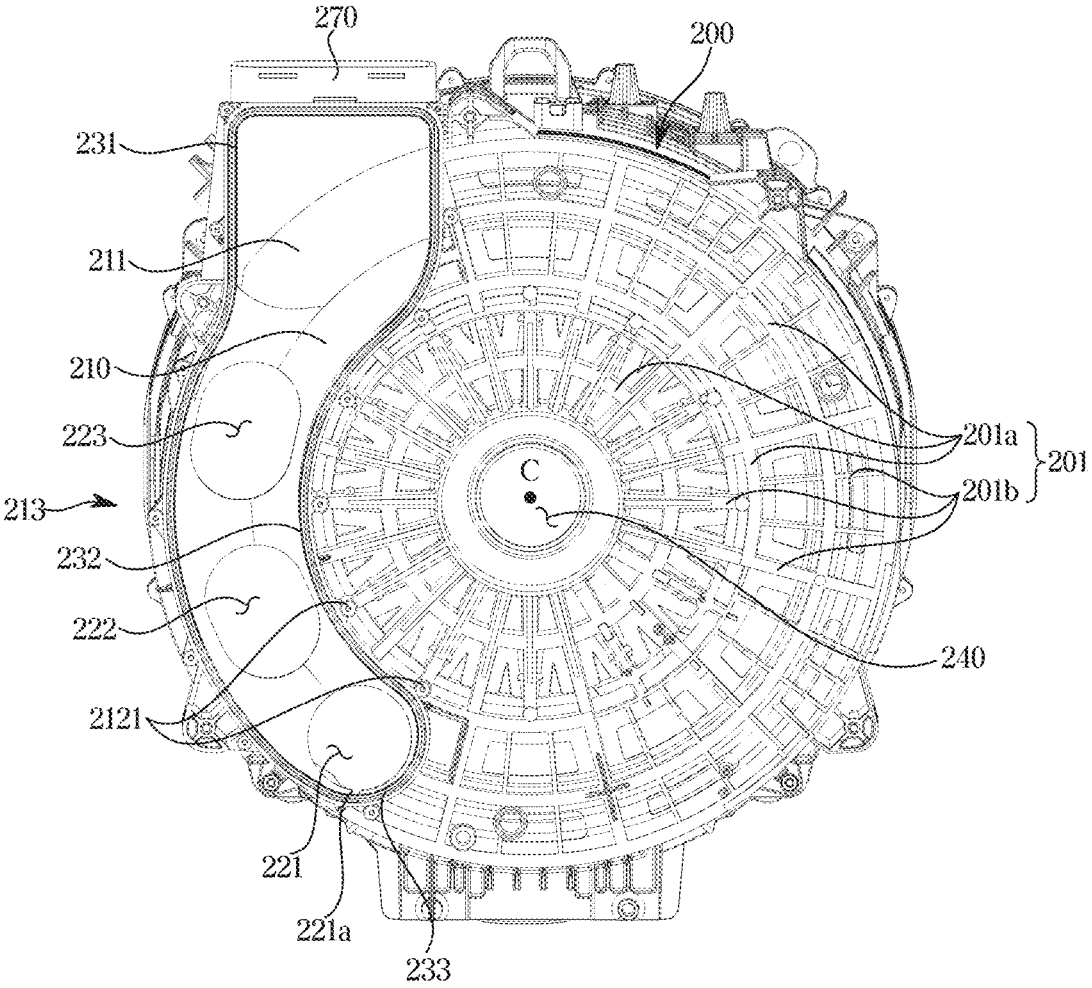
FIG. 7 is a diagram illustrating a tub back according to various embodiments.
Figure 8:
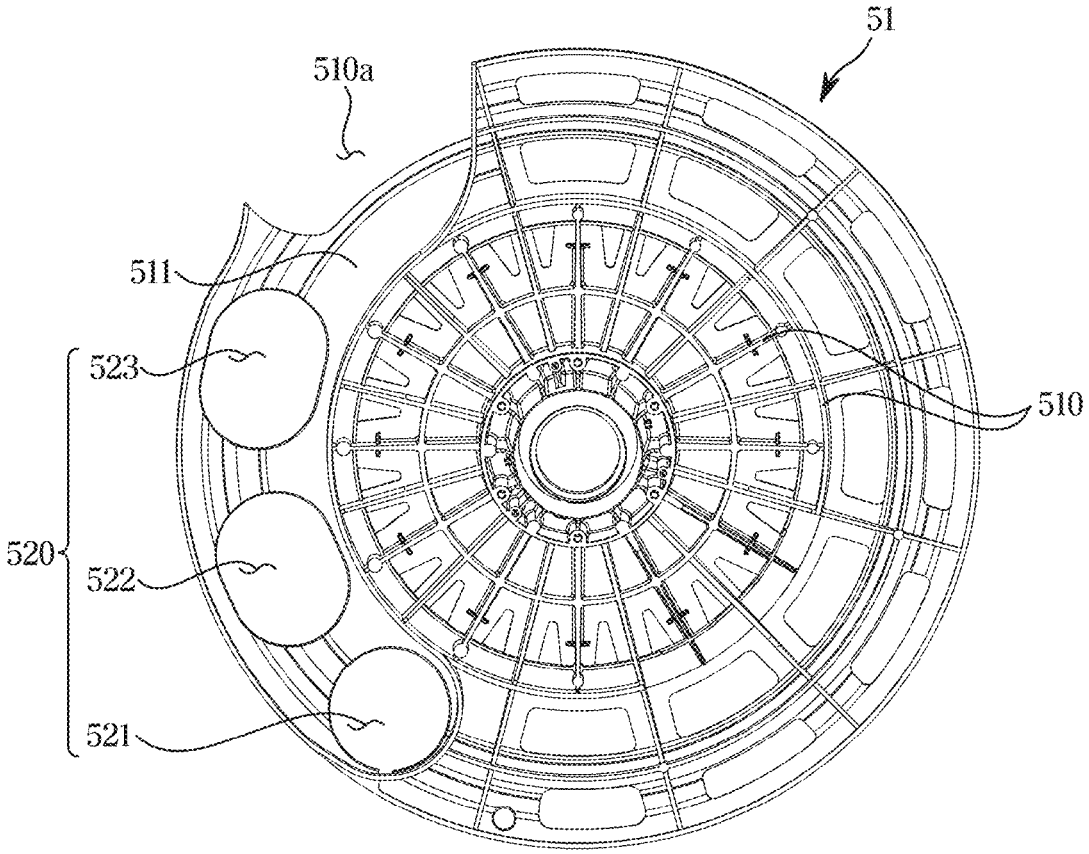
FIG. 8 is a diagram illustrating a bearing housing inserted into the tub back of FIG. 7 according to various embodiments.
Figure 9:
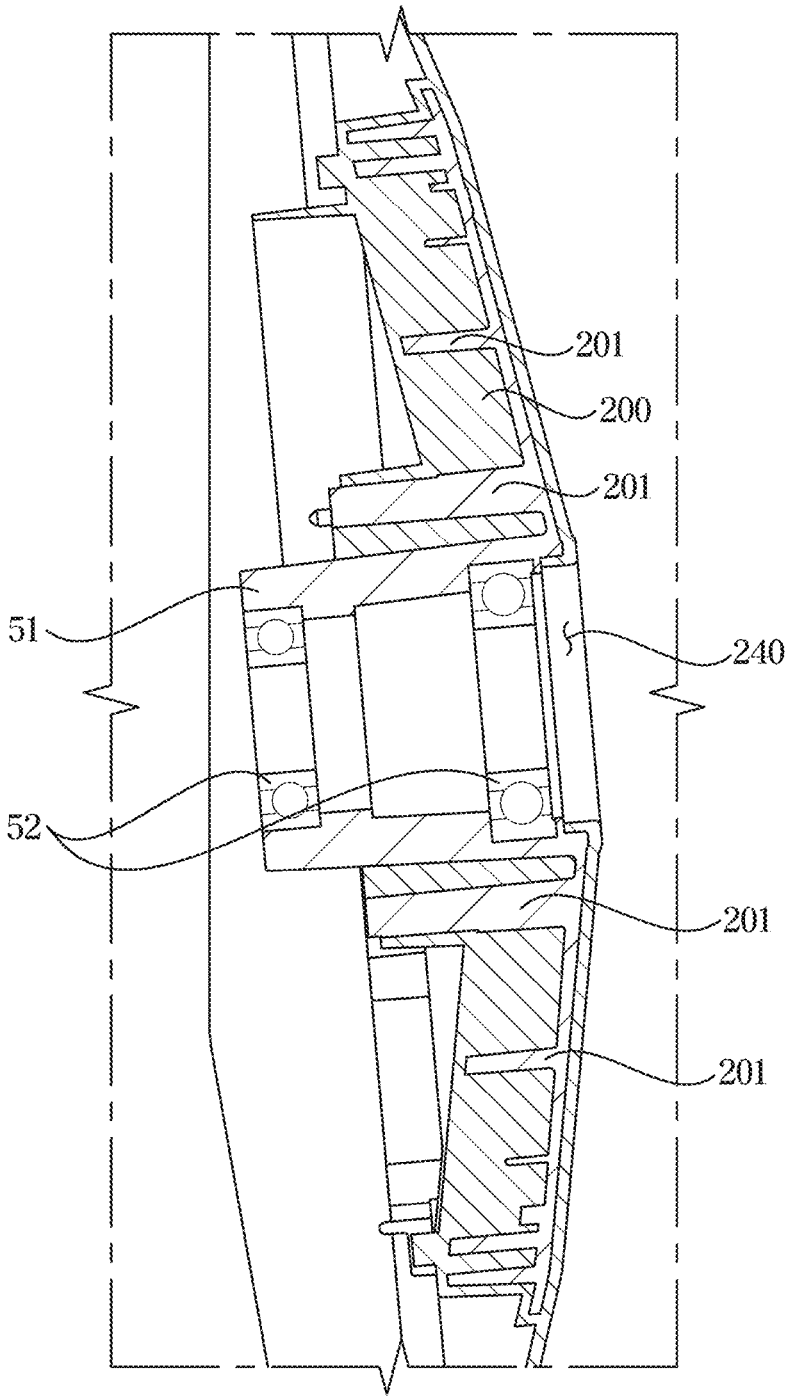
FIG. 9 is a cross-sectional view illustrating a state in which the bearing housing of FIG. 8 is inserted into the tub back of FIG. 7 according to various embodiments.
Figure 10:
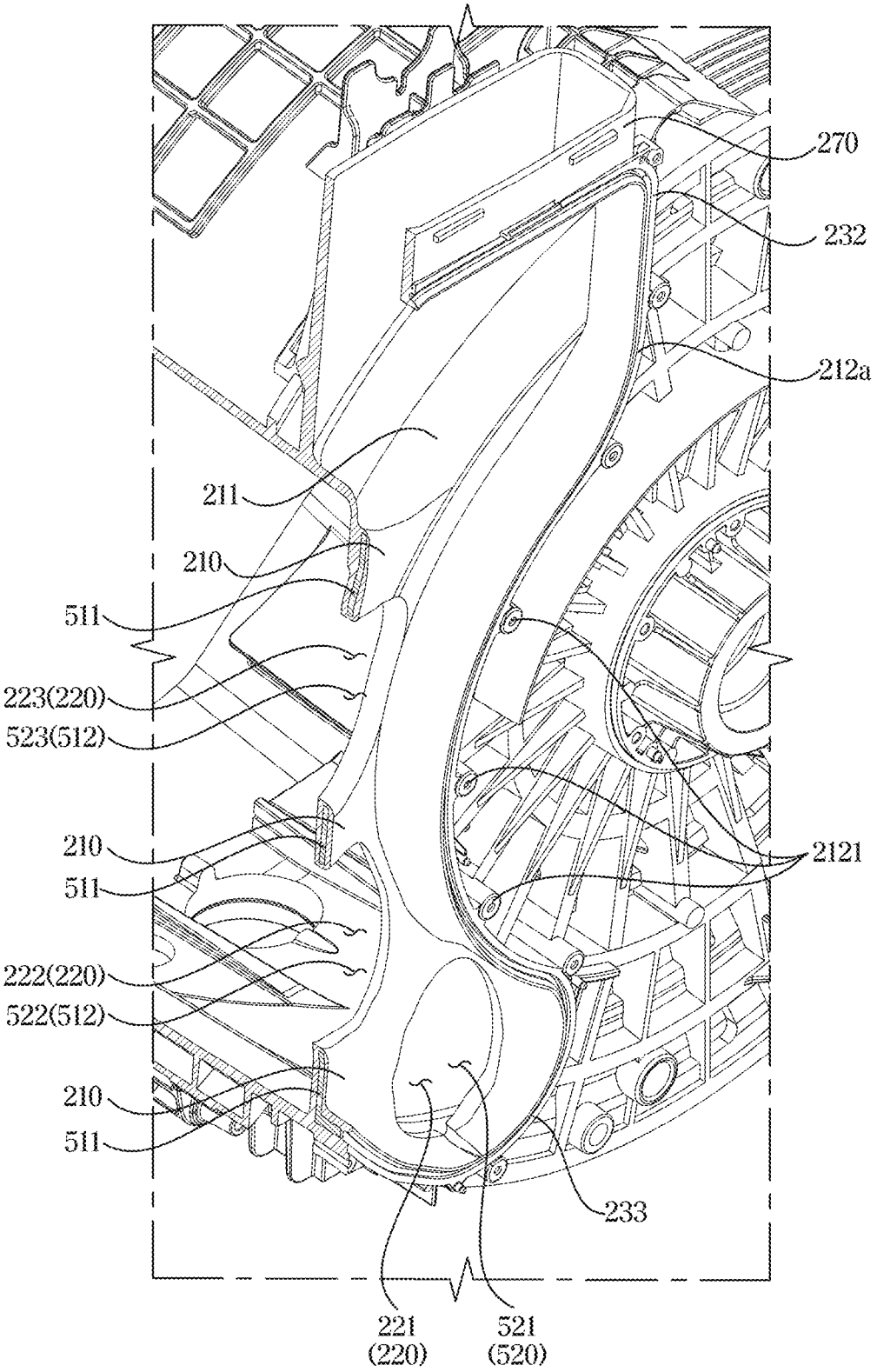
FIG. 10 is a partial perspective sectional view of an exhaust flow path according to various embodiments.

FIG. 7 is a diagram illustrating a tub back according to various embodiments. FIG. 8 is a diagram illustrating a bearing housing inserted into the tub back of FIG. 7 according to various embodiments. FIG. 9 is a cross-sectional view illustrating a state in which the bearing housing of FIG. 8 is inserted into the tub back of FIG. 7 according to various embodiments. FIG. 10 is a partial perspective sectional view of an exhaust flow path according to various embodiments.

Referring to FIG. 7 to FIG. 10 (e.g., FIGS. 7, 8, 9 and 10), the tub 20 may include a plurality of reinforcing ribs 201 to reinforce a rigidity of the tub back 200. On at least a portion of the tub back 200, the plurality of reinforcing ribs 201 may not be formed, and the recess portion 210 for forming the exhaust flow path P may be provided.

A tub through hole 240 through which the rotating shaft 41 passes may be provided in the center of the tub back 200. The tub exhaust port 220 to which the exhaust flow path P is connected may be formed on one lower side of the tub back 200.

The heated air supplied into the tub 20 through the supply flow path 78 may flow into the drum 30, absorb moisture from the laundry in the drum 30, become humid air, and be discharged from the drum 30 and the tub 20. In the above process, the heated air is required to be spread throughout the drum 30 so as to sufficiently remove the moisture in the laundry and improve a drying efficiency. To this end, a flow path connecting from the front to the rear of the drum 30 is required to be secured, and a flow path is required to reduce the amount of heated air discharged through the plurality of through holes 32*a* formed in the cylindrical drum body 32, before the heated air reaches the rear of the drum 30. According to the disclosure, the tub exhaust port 220 may be formed in the tub back 200 to increase the amount of heated air discharged to the rear of the drum 30.

By the tub exhaust port 220 formed in the tub back 200, the heated air supplied to the air inlet 26 of the tub 20 may be discharged out of the tub 20 through the tub exhaust port 220. In order to move the humid air discharged from the tub 20 back to the drying device 70, a flow path connecting the tub back 200 and the drying device 70 is required. According to an embodiment, the exhaust flow path P may be provided to move the humid air discharged from the tub 20 back to the drying device 70.

Meanwhile, the bearing housing 51 is mounted on the tub back 200, and the tub back 200 is required to have sufficient rigidity to withstand the pressure and load caused by the water stored in the tub 20. To this end, the plurality of reinforcing ribs 201 may be formed on the tub back 200. Because the reinforcing ribs 201 protrude rearward from the rear surface of the tub back 200, a front-to-back thickness of the tub back 200 increases by a length over which the reinforcing ribs 201 protrude. In the above-described structure, in order to mount a separate duct on the reinforcing ribs 201 of the tub back 200, a capacity of the housing 10 is required to be secured as much as the size of the duct. In other words, an internal space of the housing 10 is required to be increased in the front-to-back direction by the front-to-back thickness of the duct separately mounted on the tub back 200.

According to the disclosure, the reinforcing ribs 201 may not be formed on a portion of the tub back 200 to allow the portion of the tub back 200 to be used as a flow path. When a length from the front surface of the tub back 200 to the rear ends of the reinforcing ribs 201 is considered a thickness of the tub back 200, a portion of the tub back 200 may be viewed as being recessed. In the disclosure, the recess portion 210 formed in the tub back 200 may refer to an area which extends from the tub exhaust port 220 of the tub back 200 to an upper portion of the tub back 200 and in which the reinforcing ribs 201 are not formed, or an area that protrudes less than the reinforcing ribs 201.

The plurality of reinforcing ribs 201 may be formed at the rear of the tub back 200. The plurality of reinforcing ribs 201 may include annular reinforcing ribs 201*a* and radial reinforcing ribs 201*b*. The annular ribs 201*a* may have different radii centered on the tub through hole 240.

The radial reinforcing ribs 201*b* may extend in a radial direction from the tub through hole 240. In addition, the radial reinforcing ribs 201*b* may extend through the annular reinforcing ribs 201*a*. The plurality of reinforcing ribs 201 may reinforce a rigidity of the tub back 200. The plurality of reinforcing ribs 201 may include the annular reinforcing ribs 201*a* having the same center as a center C of the tub through hole 240. The annular reinforcing ribs 201*a* may have different radii. The plurality of reinforcing ribs 201 may include the radial reinforcing ribs 201*b* extending in a radial direction from the tub through hole 240. The radial reinforcing ribs 201*b* may extend through the annular reinforcing ribs 201*a*.

The tub back 200 may include the partition rib 230 protruding to the rear of the tub back 200 to partition a portion of the tub back 200 in which the recess portion 210 is formed from a remaining portion of the tub back 200. The partition rib 230 may be formed to surround the recess portion 210. The partition rib 230 may be formed along an edge of the duct connection portion 270 as well as an edge of the recess portion 210.

A height of the partition rib 230 may be higher than that of the plurality of reinforcing ribs 201. The height of the partition rib 230 higher than the height of the plurality of reinforcing ribs 201 may refer to the partition rib 230 protruding more toward the rear of the tub back 200 than the plurality of reinforcing ribs 201 protruding toward the rear of the tub back 200. In other words, the partition rib 230 may protrude more toward the rear of the tub back 200 than the plurality of reinforcing ribs 201.

The partition rib 230 may include an outer partition rib 231, an inner partition rib 232, and a connection partition rib 233.

The outer partition rib 231 may be disposed on one side of the tub exhaust port 220 in a radial direction of the tub back 200. The inner partition rib 232 may be disposed on another side of the tub exhaust port 220 in the radial direction of the tub back 200. The connection partition rib 233 may connect the outer partition rib 231 and the inner partition rib 232. The outer partition rib 231 may be disposed further from the tub through hole 240 in the radial direction of the tub back 200 than the inner partition rib 232. Accordingly, the one side of the tub exhaust port 220 may be referred to as an outer side of the tub exhaust port 220, and the other side of the tub exhaust port 220 may be referred to as an inner side of the tub exhaust port 220.

The inner partition rib 232 may extend from the annular reinforcing rib 201*a* to form a circular rib together with the annular reinforcing rib 201*a*. The outer partition rib 231 may be formed along an edge of the disk-shaped tub back 200. The outer partition rib 231 may protrude rearward from a rear edge of the tub back 200. As described above, the inner partition rib 232 may protrude more rearwardly than the annular reinforcing rib 201*a* that forms a circular rib together with the inner partition rib 232. The outer partition rib 231 may protrude toward the rear of the tub back 200 to allow a rear end of the outer partition rib 231 to be located on the same plane as a rear end of the inner partition rib 232.

The tub back 200 may include a plurality of tap holes 2121 spaced apart from each other along the partition rib 230. The plurality of tap holes 2121 may be formed outside the recess portion 210. The plurality of tap holes 2121 may be formed adjacent to each of the outer partition rib 231, the inner partition rib 232, and the connection partition rib 233.

The duct cover 100 may be coupled to the plurality of tap holes 2121. The plurality of tap holes 2121 may be spaced apart from each other by a predetermined distance. The plurality of tap holes 2121 may be formed through tapping for fastening screws. However, the disclosure is not limited thereto, and a hole for fastening a rivet, or the like, may be formed.

Referring to FIG. 7, the tub exhaust port 220 may be formed in the tub back 200 to discharge air in the tub 20.

A plurality of tub exhaust ports 220 may be formed. The plurality of tub exhaust ports 220 may be spaced apart from each other. The plurality of tub exhaust ports 220 may be spaced apart from each other along the recess portion 210.

The tub exhaust ports 220 may include a first tub exhaust port 221 formed on a lower side of the recess portion 210, a second tub exhaust port 222 formed above the first tub exhaust port 221, and a third tub exhaust port 223 formed above the second tub exhaust port 222.

The first tub exhaust port 221 may be formed on the lower side of the recess portion 210. The first tub exhaust port 221 may include a drain groove 221*a* to allow wash water to drain into the tub 20 without remaining. The drain groove 221*a* may be inclined toward the inside of the tub 20.

The second tub exhaust port 222 may be formed above the first tub exhaust port 221. The second tub exhaust port 222 and the first tub exhaust port 221 are arranged to have a gap therebetween, and thus a rigidity of the tub back 200 may be prevented/reduced from decreasing than in a case where the second tub exhaust port 222 and the first tub exhaust port 221 are formed integrally, and an air flow rate may be ensured.

The third tub exhaust port 223 may be formed above the second tub exhaust port 222. Likewise, a decrease in the rigidity of the tub back 200 may be prevented/reduced and the air flow rate may be secured.

In addition, the first tub exhaust port 221 and the second tub exhaust port 222 may be disposed below a horizontal line passing through the center C of the tub through hole 240 of the tub back 200. That is, a penetration area of a lower side of the tub exhaust port 220 may be formed to be larger than a penetration area of an upper side of the tub exhaust port 220 based on a center line of the tub through hole 240.

As described above, the drying device 70 is disposed above the tub 20, and thus the inlet flow path 76 and the supply flow path 78 may extend above the upper side of the tub 20. Accordingly, in order for the air discharged through the supply flow path 78 to effectively contact the laundry in the drum 30, a larger penetration area of the tub exhaust port 220 is required to be formed on the lower side than above the recess portion 210.

That is, in a case where a large penetration area of the tub exhaust port 220 is formed on the upper side than the lower side of the recess portion 210, the air circulating through the drying device 70 may be concentrated on an upper portion of the drum 30. That is, the drying efficiency of laundry accommodated in the drum 30 may be reduced.

However, in order to secure a sufficient flow rate, the tub exhaust port 220 may include an area formed above the center of the tub back 200. For example, the tub exhaust port 220 may include the third tub exhaust port 223 formed above the center of the tub back 200.

In addition, a distance between the first tub exhaust port 221, the second tub exhaust port 222, and the third tub exhaust port 223 may be set as a distance that may maintain a structural rigidity of the tub 20 and the tub back 200, while the second tub exhaust port 222 and the third tub exhaust port 223 are arranged as adjacent as possible to the first tub exhaust port 221. In addition, the distance may be set as a theoretically calculated value or as an experimental value obtained through repeated experiments.

Although the three tub exhaust ports 220 are illustrated in the drawings, the disclosure is not limited thereto. The shape and the number of tub exhaust ports 220 may vary. For example, the tub exhaust ports 220 may be small holes densely arranged, or may have a mesh or grille shape.

The tub 20 may be formed of a plastic material. The bearing housing 51 may be inserted into the tub back 200. That is, when injection molding the tub 20, the tub 20 may be injected with the bearing housing 51 inserted.

Referring to FIG. 8, the bearing housing 51 may include a material having higher rigidity than a material forming the tub 20. The bearing housing 51 may be formed of Aluminum Die Casting (ALDC) or stainless steel.

The bearing housing 51 may be inserted into the tub back 200 to reinforce the rigidity of the tub back 200. For example, a recess reinforcement portion 511 of the bearing housing 51 may reinforce a rigidity of the recess portion 210 of the tub back 200.

The tub through hole 240 through which the rotating shaft 41 of the drive motor 42 passes may be formed in the tub back 200. The bearing 52 may be inserted into the tub through hole 240, and may rotatably support the rotating shaft 41.

The load caused by the water and laundry accommodated in the drum 30 is transmitted to the tub back 200 in which the tub through hole 240 is formed, through the rotating shaft 41 and the bearing 52. Because a rigidity of the tub back 200 is weak to support the load, the bearing housing 51 may be provided in the tub back 200.

The bearing housing 51 according to an embodiment may be in a disk shape having substantially the same diameter as the disk-shaped tub back 200.

In general, the bearing housing 51 may have a size smaller than the diameter of the tub back 200. However, the bearing housing 51 according to the disclosure may have a diameter that is equal to or similar to that of the tub back 200.

As described above, the tub exhaust port 220 may be formed in the tub back 200 to discharge the air in the tub 20, and the recess portion 210 forming the tub duct 213 may be formed around the tub exhaust port 220 for a smooth air flow. However, due to the tub exhaust port 220, formed through the tub back 200, and the recess portion 210 in which the reinforcing ribs 201 are not formed as a surrounding of the tub exhaust port 220, the rigidity of the tub back 200 may be reduced. To reinforce the rigidity of the tub back 200, the bearing housing 51 according to an embodiment may be provided to have a diameter and shape of substantially the same size as the tub back 200.

Air is required to be discharged through the tub exhaust port 220 located in the recess portion 210. The tub back 200 may include the tub exhaust port 220 formed to discharge air in the tub 20. In addition, the bearing housing 51 may include a housing exhaust port 520.

The housing exhaust port 520 may be formed to correspond to the tub exhaust port 220. In a case where a plurality of tub exhaust ports 220 are formed, a plurality of housing exhaust ports 520 may also be formed. That is, when the tub back 200 is injection molded, the bearing housing 51 may be inserted into the tub back 200 to allow the housing exhaust port 520 and the tub exhaust port 220 to overlap in position.

The housing exhaust port 520 may include a first housing exhaust port 521 corresponding to the first tub exhaust port 221. The first housing exhaust port 521 may be formed below the recess reinforcement portion 511.

The first housing exhaust port 521 may include a housing drain groove 521*a* formed to correspond to the drain groove 221*a* formed in the first tub exhaust port 221. Like the drain groove 221*a*, the housing drain groove 521*a* may be inclined toward the inside of the tub 20.

The housing exhaust port 520 may include a second housing exhaust port 522 corresponding to the second tub exhaust port 222 and a third housing exhaust port 523 corresponding to the third tub exhaust port 223.

The second housing exhaust port 522 may be formed above the first housing exhaust port 521. In addition, the third housing exhaust port 523 may be formed above the second housing exhaust port 522.

Likewise, the recess reinforcement portion 511 of the bearing housing 51 may be formed to correspond to the recess portion 210 of the tub back 200. When the tub back 200 is injection molded, the bearing housing 51 may be inserted to allow the recess reinforcement portion 511 and the recess portion 210 to overlap in position.

The tub back 200 may include a step portion 211 to expand a cross-sectional area of the exhaust flow path P. The step portion 211 may be formed by a portion of the recess portion 210 being stepped forward from a remaining portion of the recess portion 210.

The recess portion 210 and a front end of the duct connection portion 270 may be formed to be spaced apart in the front-back direction. In other words, the front end of the duct connection portion 270 forming a portion of the exhaust flow path P may be located ahead of the recess portion 210. The step portion 211 may extend obliquely from the recess portion 210 toward the duct connection portion 270 to connect the recess portion 210 and the front end of the duct connection portion 270. The step portion 211 may be formed to facilitate the air flow on a downstream side of the exhaust flow path P connected to the inlet flow path 76.

The bearing housing 51 may include an avoidance portion 311 corresponding to the step portion 211. Because the bearing housing 51 is not easily inserted into a portion recessed more than the recess portion 210, the avoidance portion 311 may be formed to avoid the above. The avoidance portion 311 may be formed in a portion of the recess reinforcement portion 310 corresponding to the step portion 211. The avoidance portion 311 may refer to a groove or hole having a shape corresponding to the step portion 211. Because the avoidance portion 311 is a groove or a hole of a shape corresponding to the step portion 211, the bearing housing 51 may not be inserted into the inside of the step portion 211. That is, the bearing housing may not be formed in an area corresponding to the step portion 211 of the tub back 200. The bearing housing 51 may include an avoidance portion 510*a* corresponding to the step portion 211. Because the bearing housing 51 is not easily inserted into a portion recessed more than the recess portion 210, the avoidance portion 510*a* may be formed to avoid the above. The avoidance portion 510*a* may be formed in a portion of the recess reinforcement portion 511 corresponding to the step portion 211.

The recess portion 210 and the duct connection portion 270 may be formed in a stepped manner. The step portion 211 may be formed by recessing a portion of the recess portion 210 adjacent to the duct connection portion 270. The flow rate may be reduced due to a step formed between the step portion 211 and the duct connection portion 270 in the exhaust flow path P. Accordingly, the step portion 211 may be formed to secure the flow rate of air flowing into the duct connection portion 270.

The bearing housing 51 may include a plurality of housing ribs 510 corresponding to the plurality of ribs 201 formed in the tub back 200. The plurality of housing ribs 510 may be formed to correspond to the plurality of ribs 201 formed in the tub back 200.

The plurality of housing ribs 510 may be formed to correspond to the annular reinforcing ribs 201*a* and the radial reinforcing ribs 201*b* including the plurality of ribs 201. The plurality of ribs 201 are not formed in the portion forming the recess portion 210 of the tub back 200, and also in the bearing housing 51, the plurality of housing ribs 510 may not be formed in the recess reinforcement portion 511.

Figure 11:
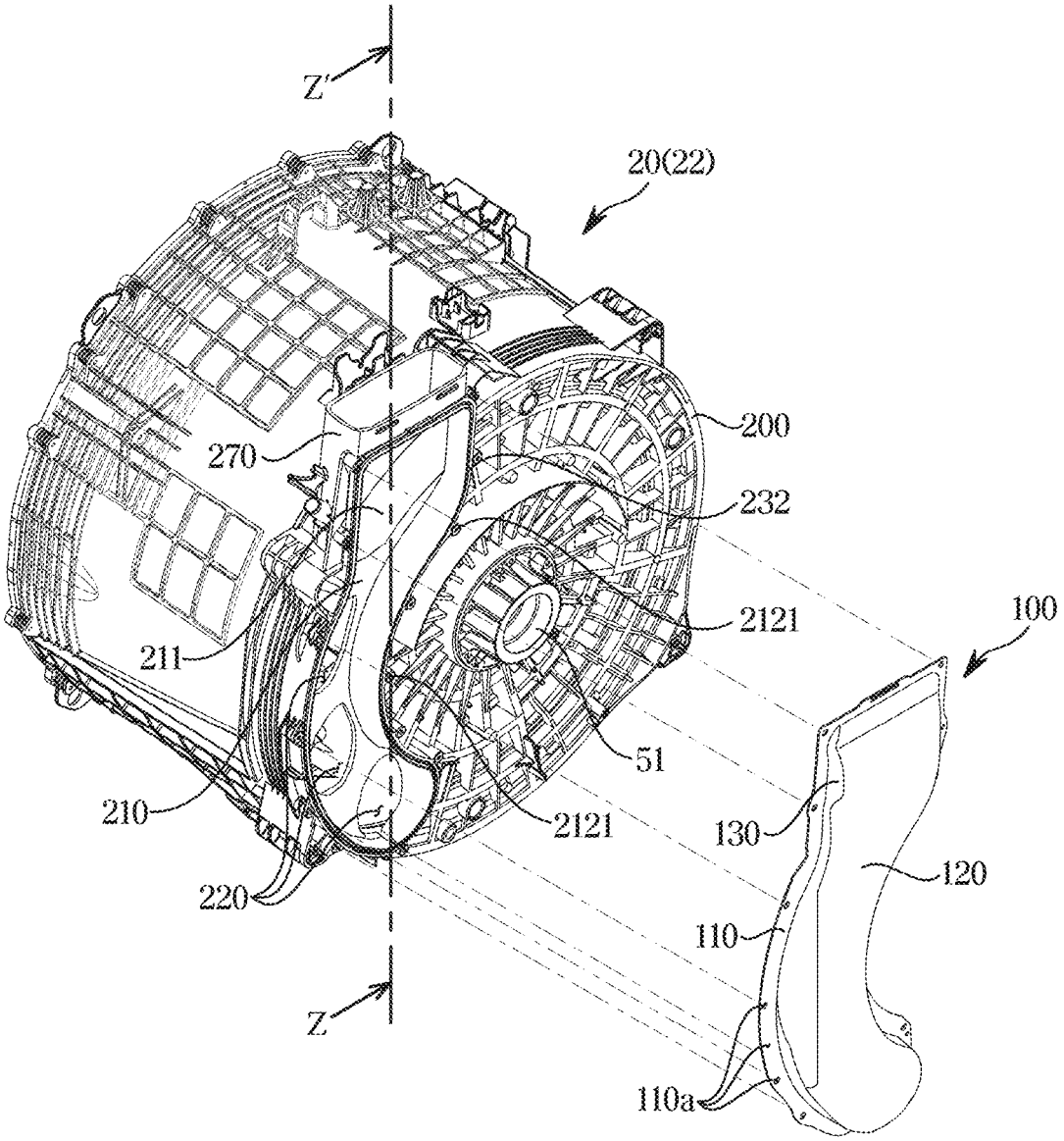
FIG. 11 is an exploded perspective view illustrating a state in which a tub back and a duct cover are coupled according to various embodiments.
Figure 12:
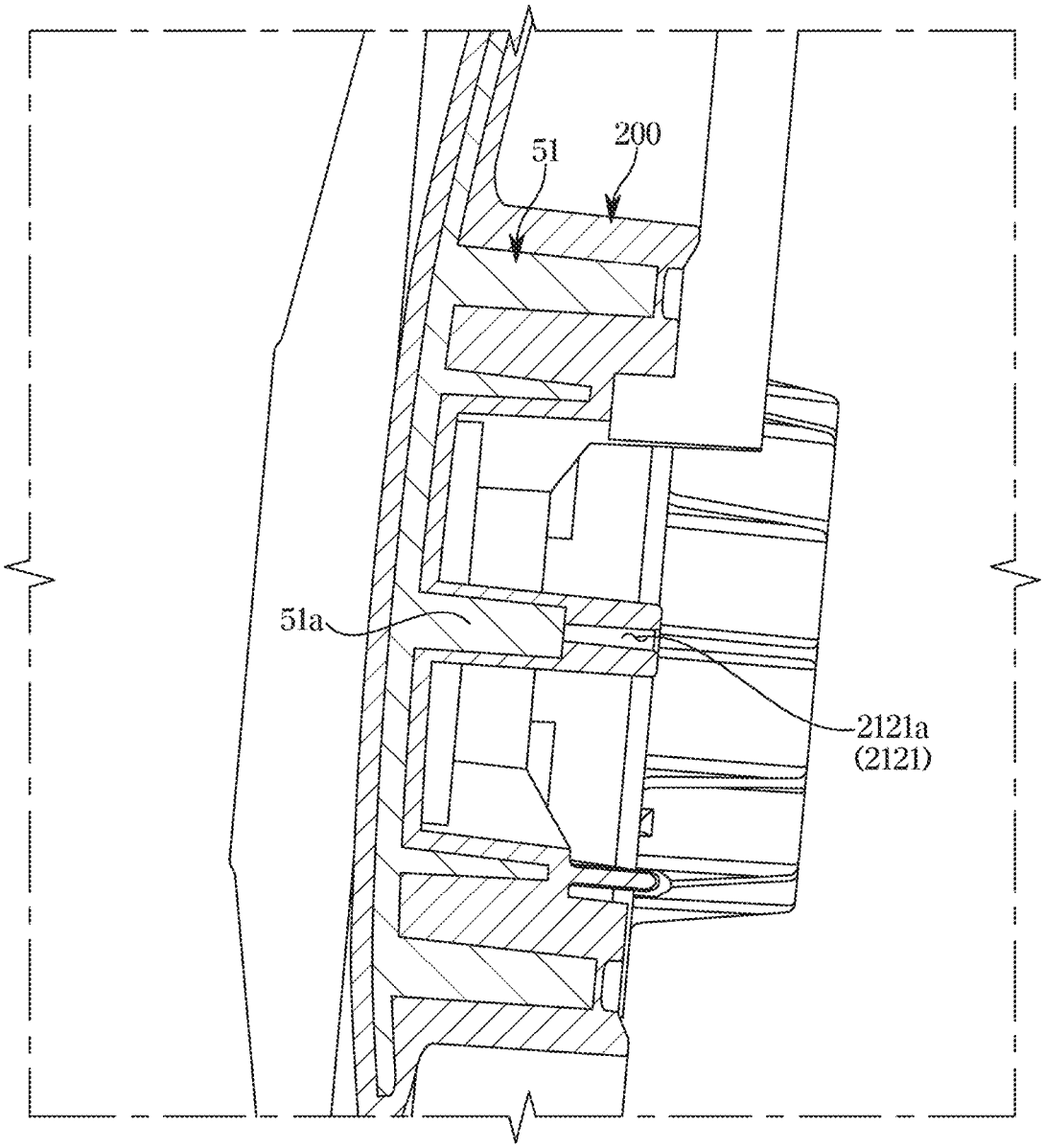
FIG. 12 and FIG. 13 are diagrams illustrating enlarged views illustrating an area of the tub of FIG. 11 where a tub back and a duct cover are coupled, taken along line Z-Z' according to various embodiments.
Figure 13:
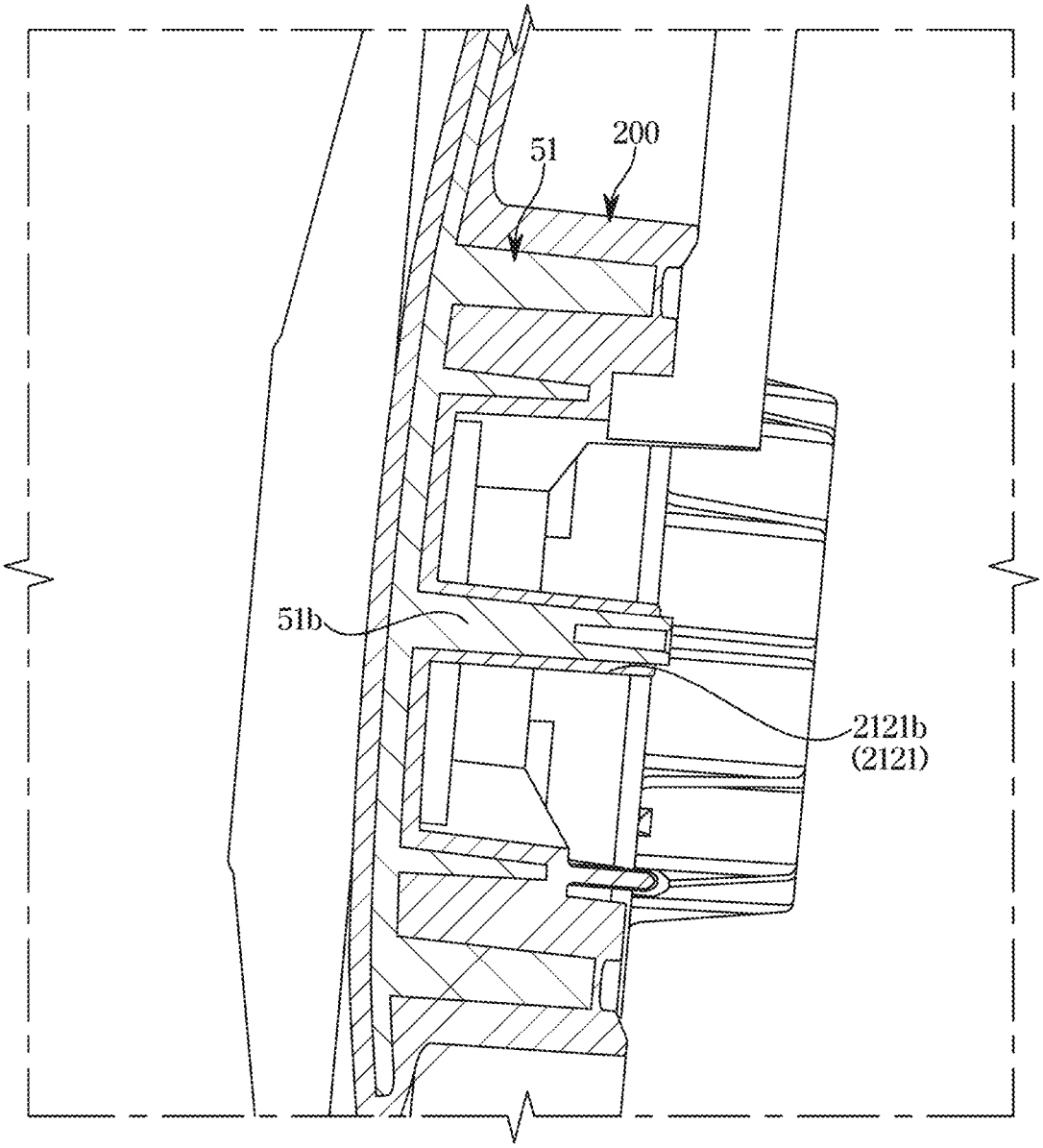

FIG. 11 is a perspective view illustrating a state in which a tub back and a duct cover are coupled according to various embodiments. FIG. 12 and FIG. 13 are diagrams illustrating enlarged views illustrating an area of the tub of FIG. 11 where a tub back and a duct cover are coupled, taken along line Z-Z' according to various embodiments.

The duct cover 100 may be coupled to the tub back 200. The duct cover 100 may be coupled to cover the recessed portion 210 of the tub back 200.

The duct cover 100 may include a cover portion 120 formed to correspond to the recess portion 210 so as to cover the recess portion 210. The duct cover 100 may include a connection portion 130 that is bent from a fastening flange portion 110 and connects the cover portion 120 and the fastening flange portion 110.

The cover portion 120 may protrude outwardly than the fastening flange portion 110. When the duct cover 100 is coupled to the tub 20, the cover portion 120 may protrude in a direction away from the recess portion 210.

The connection portion 130 may extend outwardly to allow the cover portion 120 to protrude from the fastening flange portion 110. In other words, when the duct cover 100 is positioned to cover the recess portion 210, the connection portion 130 extends rearward, and thus the cover portion 120 extends rearward.

Although not illustrated, the duct cover 100 may be formed in a plate shape in which the cover portion 120 and the fastening flange portion 110 are integrally formed. A shape of the duct cover 100 is not limited as long as the duct cover 100 may cover the recess portion 210.

Although it is illustrated that the duct cover 100 is fastened to the tub back 200 by screws, a connection method is not limited thereto. For example, the duct cover 100 may be coupled without a separate fastening means such as a snapfit or latch.

The duct cover 100 may include a material having higher rigidity than a material forming the tub 20. For example, the duct cover 100 may be formed of Aluminum Die Casting (ALDC) or stainless steel, like the bearing housing 51. However, the disclosure is not limited thereto, and the duct cover 100 is sufficient as long as it has a higher rigidity than the material forming the tub 20.

The duct cover 100 may include the fastening flange portion 110 in which a fastening hole 110*a* is formed. The fastening flange portion 110 may be provided with a plurality of fastening holes 110*a*. The plurality of fastening holes 110*a* may be spaced apart from each other along the fastening flange portion 110.

Referring to FIG. 12, the plurality of fastening holes 110*a* may be formed to correspond to a plurality of tap holes 2121*a* formed in the tub back 200. The duct cover 100 and the tub back 200 may be fastened by screws inserted into the plurality of fastening holes 110*a* and the plurality of tap holes 2121*a*.

Although not illustrated, a fastening structure may also be formed in a fastening portion 51*a* of the bearing housing 51 through tapping. The screw may pass through the tab hole 2121*a* and may be inserted into the fastening portion 51*a*. That is, the duct cover 100 may be coupled to both the tub back 200 and the bearing housing 51.

In this case, the duct cover 100 may be coupled to the tub back 200. Because the duct cover 100 has higher rigidity than the tub back 200, a rigidity of the exhaust flow path P may be secured. In addition, because the bearing housing 51, which has a higher rigidity than the tub back 200, is inserted into the tub back 200, rigidity reinforcement may be achieved at the same level as when the bearing housing 51 and the duct cover 100 of FIG. 12 are directly coupled, which will be described later.

With reference to FIG. 13, a coupling structure according to an embodiment, different from the embodiment of FIG. 12, is described.

The bearing housing 51 may include a fastening portion 51*b* that protrudes through the tub back 200. For example, the fastening portion 51*b* may protrude rearward through a fastening protrusion 2121*b* formed on the tub back 200. That is, the fastening portion 51*b* may protrude rearward through the fastening protrusion 2121*b*.

A fastening structure may be formed in the fastening portion 51*b* of the bearing housing 51 through tapping, like the tab hole 2121*a* of FIG. 12, without being limited thereto. A hole may be formed to be coupled through a rivet.

The fastening hole 110*a* of the duct cover 100 and the fastening portion 51*b* of the bearing housing 51 may be positioned to correspond to each other. When the fastening hole 110*a* is positioned to correspond to the fastening portion 51*b*, a screw may be inserted.

The duct cover 100 may be formed of the same material as the bearing housing 51. For example, both the duct cover 100 and the bearing housing 51 may be formed of Aluminum Die Casting (ALDC) or stainless steel. However, the disclosure is not limited thereto, and materials of the duct cover 100 and the bearing housing 51 are sufficient as long as the duct cover 100 and the bearing housing 51 are formed of a material having a higher rigidity than the material forming the tub 20.

In this case, the duct cover 100 may be directly coupled to the bearing housing 51. By directly coupling the duct cover 100 and the bearing housing 51, a rigidity of the exhaust flow path P may be reinforced. For example, in a case where the duct cover 100 and the bearing housing 51 are formed of Aluminum Die Casting (ALDC), which is similar to forming the exhaust flow path P by ALDC, and thus the rigidity of the exhaust flow path P This may be reinforced.

Figure 14:
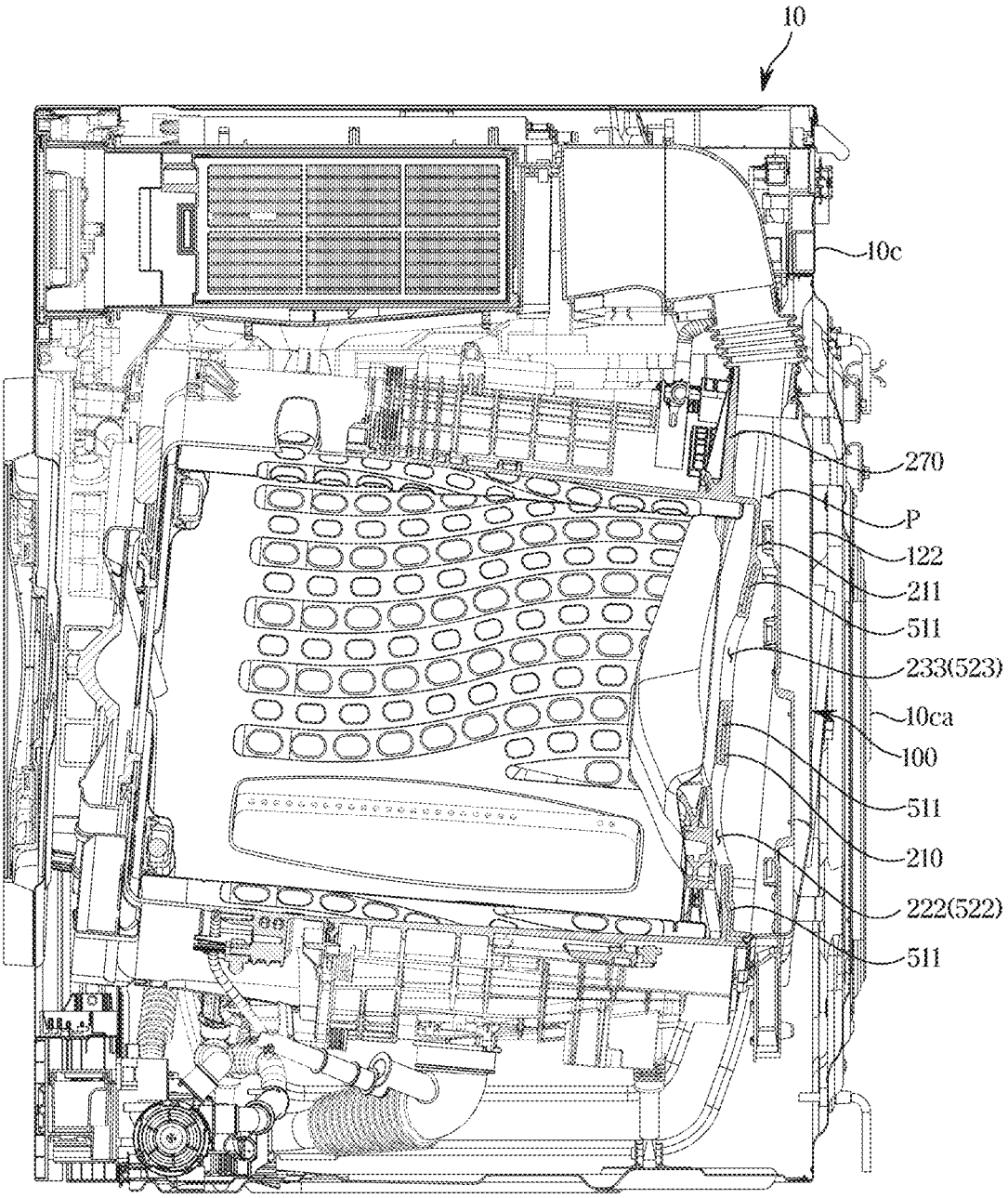
FIG. 14 is a cross-sectional view illustrating the housing and the clothes care apparatus of FIG. 1 according to various embodiments.
Figure 15:
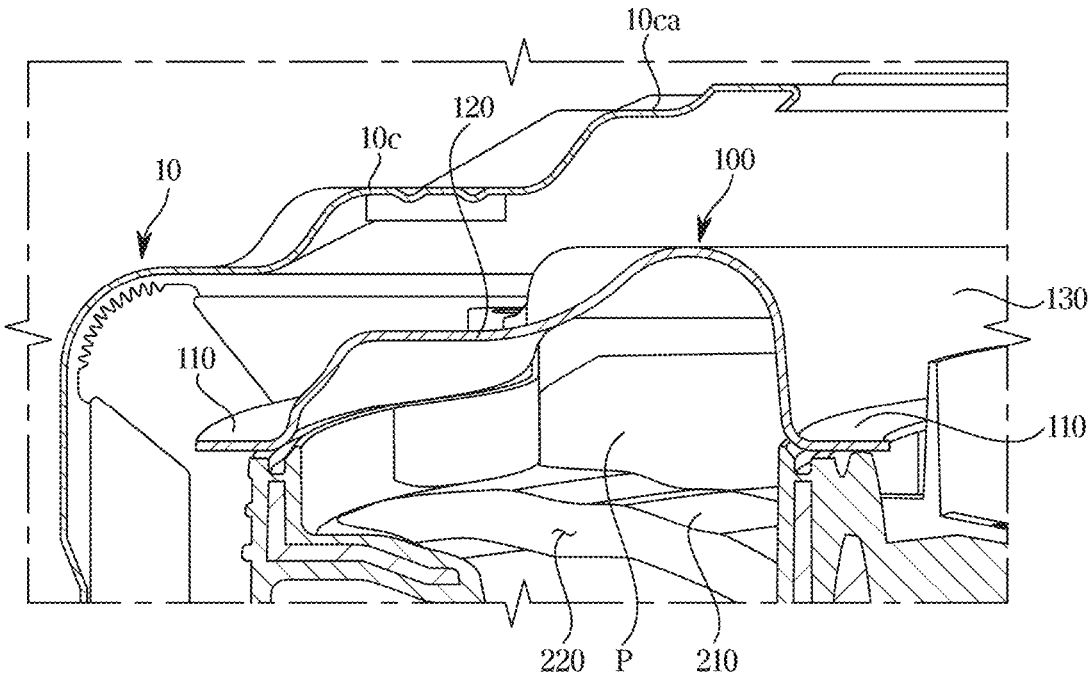
FIG. 15 is a diagram illustrating an enlarged cross-sectional view illustrating a portion of the clothes care apparatus of FIG. 1 taken along line different from FIG. 14 according to various embodiments.

FIG. 14 is a cross-sectional view illustrating the housing and the clothes care apparatus of FIG. 1 taken along line X-X' according to various embodiments. FIG. 15 is an enlarged cross-sectional view illustrating a portion of the clothes care apparatus of FIG. 1 taken along line Y-Y' according to various embodiments.

Referring to FIG. 14, the tub 20 may be inclined upward toward the front. That is, an opening of the tub 20 located on the opposite side to the tub back 200 may face upward and forward. Accordingly, the tub back 200 may face downward and rearward. In other words, the tub 20 may be inclined with respect to the rear frame 10*c* of the housing 10.

A distance between the rear frame 10*c* and the tub back 200 may increase toward a lower portion of the rear frame 10*c*. Conversely, the distance between the rear frame 10*c* and the tub back 200 may decrease toward an upper portion of the rear frame 10*c*.

In a case where the duct cover 100 has a predetermined thickness, interference may occur with the upper portion of the rear frame 10*c* having a short distance from the rear frame 10*c*. In this case, noise, and the like, may occur due to vibrations generated when the clothes care apparatus 1 operates.

In order to prevent/reduce the above, the duct cover 100 may include a cover inclined portion 122 in which a protruding length of a portion coupled to a lower side of the tub back 200 is formed to be longer than a protruding length of a portion coupled to an upper side of the tub back 200. The cover inclined portion 122 may be formed only on a portion of an upper portion of the duct cover 100.

For example, the cover inclined portion 122 may be formed to allow the length protruding rearward from the fastening flange portion 110 to increase toward the lower side of the tub back 200, so as to be spaced apart from the rear frame 10*c* of the housing 10 by a predetermined distance. That is, the length in which the connection portion 130 extends rearward may be longer at a portion coupled to the lower side of the tub back 200 than at a portion coupled to the upper side of the tub back 200.

In this instance, a cross-sectional area of the exhaust flow path P in the portion coupled to the upper side of the tub back 200 may be reduced, and thus a flow rate may also be reduced. To prevent the above, the recess portion 210 may include the step portion 211 formed above the recess portion 210. The step portion 211 may be formed adjacent to the duct connection portion 270.

The step portion 211 may be formed by recessing at least a portion of the recess portion 210 inward of the tub 20. That is, the step portion 211 may be formed by recessing forward above the recess portion 210. However, a shape of the step portion 211 is not limited thereto, and may be formed like the flow path expansion portion 211*a* shown in FIG. 16 and FIG. 17, which will be described later.

Referring to FIG. 15, the housing 10 may include a rear recess portion 10*ca* in which a portion of the rear frame 10*c* is recessed outward in a stepped manner. In other words, the rear recess portion 10*ca* may protrude from the rear frame 10*c* in a direction away from the duct cover 100. The rear recess portion 10*ca* may be formed to be spaced apart from a portion where the rotating shaft 41 protrudes rearward. The rear recess portion 10*ca* may be the rearmost portion of the rear frame 10*c*.

The cover portion 120 of the duct cover 100 may be formed to be spaced apart from the rear frame 10*c* of the housing 10 by a predetermined distance. Specifically, the cover portion 120 may be formed to be spaced apart from the rear recess portion 10*ca* and the rear frame 10*c* of the housing 10 by a predetermined distance.

Because the duct cover 100 is located at the rear of the tub back 200, the duct cover 100 may be adjacent to the rear frame 10*c*. In order for the duct cover 100 to be spaced apart from the rear frame 10*c* by a predetermined distance, an extension length of the connection portion 130 connecting the cover portion 120 and the fastening flange portion 110 may be formed to be short. That is, the duct cover 100 may be formed to be thin.

However, in a case where a thickness of the duct cover 100 is thin, a flow rate flowing through the exhaust flow path P may be reduced. In order to prevent the above, a maximum thickness of the duct cover 100 is required.

The cover portion 120 of the duct cover 100 may be formed to correspond to the rear frame 10*c* and the rear recess portion 10*ca*. A portion of the cover portion 120 may be formed in a stepped manner so as to be spaced apart from the rear frame 10*c* and the rear recess portion 10*ca* by a predetermined distance.

The cover portion 120 may be formed to have a portion protruding toward the rear recess portion 10*ca*. A portion of the cover portion 120 corresponding to the rear recess portion 10*ca* may protrude toward the rear recess portion 10*ca*. That is, a portion of the cover portion 120 corresponding to the rear recess portion 10*ca* may be formed to be stepped from the portion of the rear frame 10*c* other than the rear recessed portion 10*ca*. However, a shape of the duct cover 100 is not limited thereto, and may be provided in any shape as long as the duct cover 100 may be spaced apart from the rear frame 10*c* by a predetermined distance.

Figure 16:
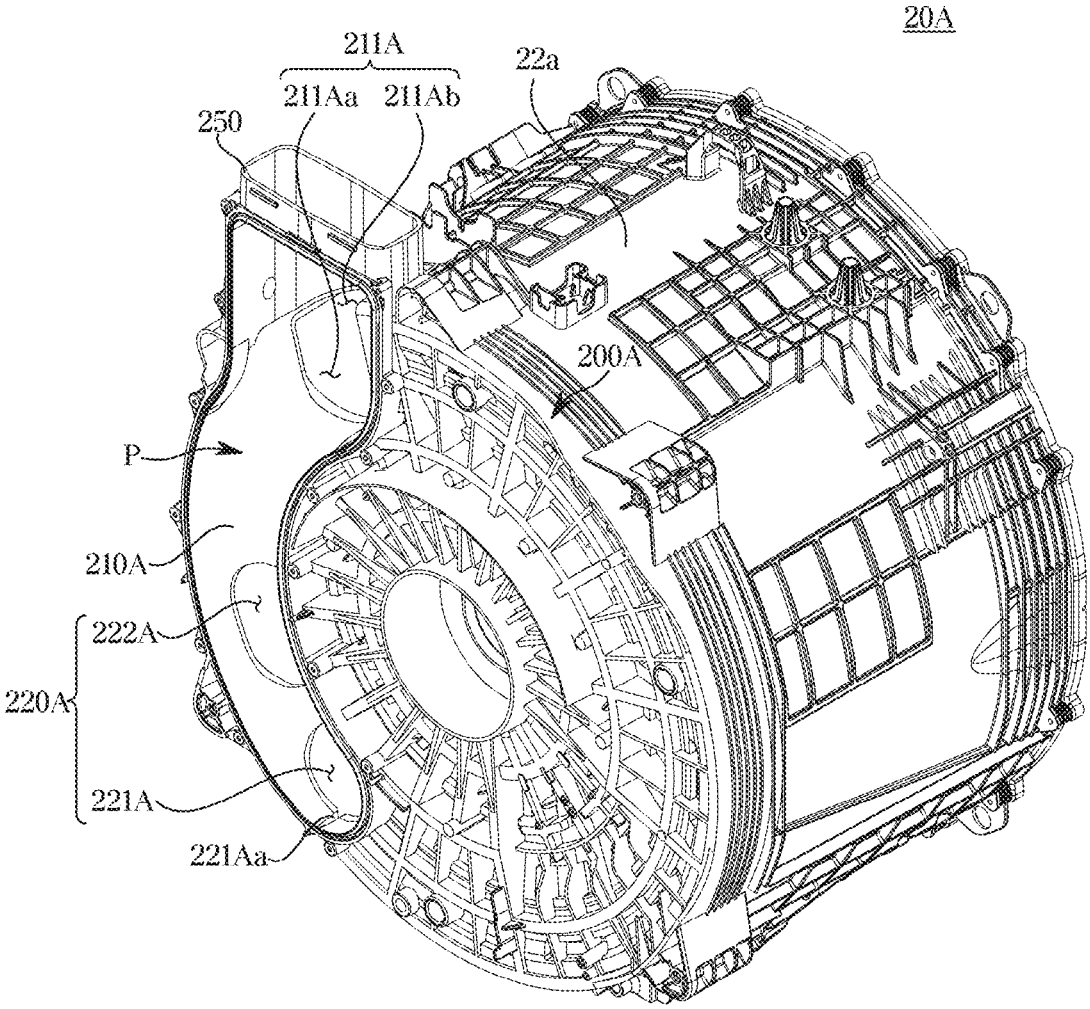
FIG. 16 is a rear perspective view illustrating a tub according to various embodiments.
Figure 17:
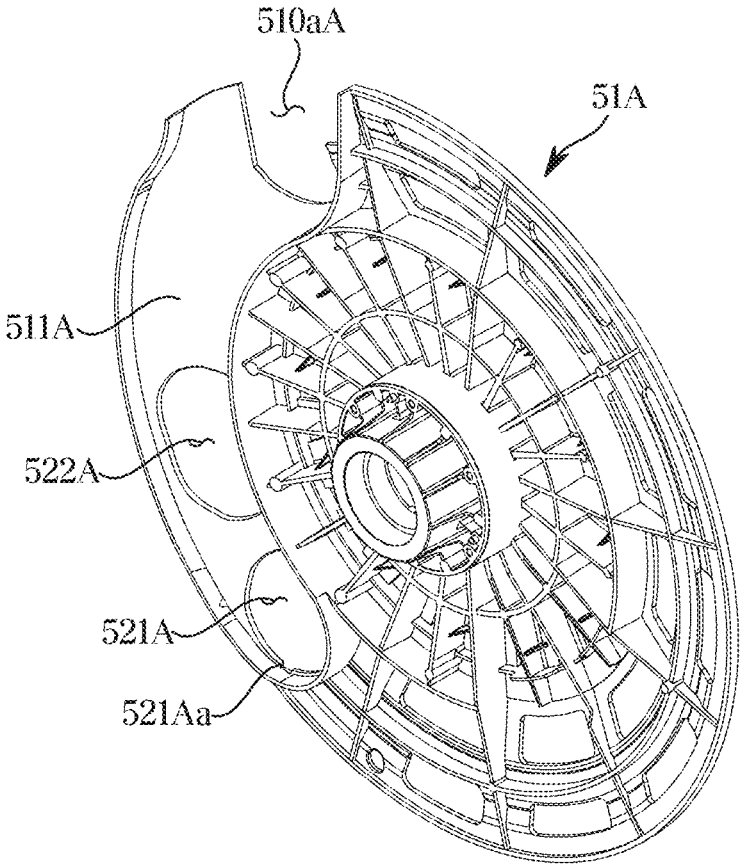
FIG. 17 is a perspective view illustrating a bearing housing provided to be inserted into the tub of FIG. 16 according to various embodiments.

FIG. 16 is a rear perspective view illustrating a tub according to various embodiments. FIG. 17 is a perspective view illustrating a bearing housing provided to be inserted into the tub of FIG. 16 according to various embodiments.

Hereinafter, an embodiment different from the embodiments of FIG. 1 to FIG. 15 is described. With reference to FIG. 16 and FIG. 17, an embodiment of the disclosure is described in greater detail. The same components as the embodiments shown in FIG. 1 to FIG. 14 are assigned the same reference numerals, and thus detailed descriptions may not be repeated here.

Referring to FIG. 16 and FIG. 17, a tub back 200A may include a flow path expansion portion 211A formed in a recess portion 210A. The flow path expansion portion 211A may be formed above the recess portion 210A. That is, The flow path expansion portion 211A may be formed adjacent to the duct connection portion 270.

As described above, a cross-sectional area of an exhaust flow path P may be reduced in the portion adjacent to the duct connection portion 270, that is, an upper side of the tub back 200A, and thus the flow path expansion portion 211A is preferably formed on the upper side of the tub back 200A.

The flow path expansion portion 211A may be formed by cutting a portion of the tub 20. For example, the flow path expansion portion 211A may be formed by cutting a portion of the tub back 200A and a tub body 22*a*.

The tub back 200A may include a first tub exhaust port 221A formed below the recess portion 210A, and a second tub exhaust port 222A formed above the first tub exhaust port 221A. The tub 20A according to the disclosure may include two tub exhaust ports 220A.

A tub drain groove 221Aa may be formed in the first tub exhaust port 221A to allow wash water to drain into the tub 20A without remaining.

A bearing housing 51A may include a first housing exhaust port 521A corresponding to the first tub exhaust port 221A, and a second housing exhaust port 522A corresponding to the second tub exhaust port 222A.

In the first housing exhaust port 521A, a housing drain groove 521Aa may be formed to correspond to the tub drain groove 221Aa formed in the first tub exhaust port 221A. The flow path expansion portion 211A may include a portion of the tub exhaust port 220A formed in the recess portion 210A of the tub back 200A. That is, the flow path expansion portion 211A may be formed across the tub back 200A and the tub body 22*a*. The bearing housing 51A may be formed to correspond to a shape of the tub back 200A. The bearing housing 51A may include an avoidance portion 510*a*A to correspond to the flow path expansion portion 211A.

The flow path expansion portion 211A may include a first partial flow path expansion portion 211Aa in which a portion of the recess portion 210A is cut, and a second partial flow path expansion portion 211Ab in which a portion of the tub body 22*a* is cut. The first partial flow path expansion portion 211Aa may perform the same function as the tub exhaust port 220. Because the bearing housing 51A is not inserted into the tub body 22*a*, the bearing housing 51A may not have a shape corresponding to the second partial flow path expansion portion 211Ab.

Although it is illustrated that two tub exhaust ports 220A and a single flow path expansion portion 211A exist, a configuration of the two tub exhaust ports 220A and the one flow path expansion portion 211A may have a similar effect as three tub exhaust ports 220.

As such, a cross-sectional area through which the air in the tub 20 may flow may be increased by the flow path expansion portion 211A, and thus a flow rate that may move through the duct connection portion 270 may be increased.

According to an embodiment, a clothes care apparatus may include a housing 10 in which a laundry inlet 14 is formed on a front; a tub 20 provided in the housing and configured to store water; a drum 30 configured to be rotatable in the tub and accommodate laundry; and a drying device 70 disposed above the tub and configured to remove moisture from air exhausted from the tub and supply heated air to the tub. The tub may include a tub back 200 provided on a rear surface of the tub and including a plurality of reinforcing ribs protruding rearward to reinforce a rigidity of the tub back, and a tub duct 213 formed in a portion of the tub back, configured to guide the air that is exhausted from the tub to the drying device, and including a tub exhaust port 220 formed to exhaust air in the tub and a recess portion 210 recessed further forward than rear ends of the plurality of reinforcing ribs. According to the disclosure, a space inside a washing machine may be secured. According to the disclosure, an exhaust flow path may be integrally formed with the tub back. According to the disclosure, a rigidity of the tub in which the exhaust flow path is formed may be reinforced.

The clothes care apparatus may further include a bearing housing including a material stronger than the tub, and configured to rotatably support a rotating shaft connected to the drum. The bearing housing may include a recess reinforcement portion inserted into the recess portion to reinforce a rigidity of the recess portion, and a housing exhaust port corresponding to the tub exhaust port. The bearing housing may include the recess reinforcement portion corresponding to the recess portion. According to the disclosure, the rigidity of the tub in which the exhaust flow path is formed may be reinforced.

The clothes care apparatus may further include a duct cover 100 coupled to the tub to cover the tub duct, and configured to form an exhaust flow path for guiding air, exhausted through the tub exhaust port, to the drying device by covering the tub duct.

The duct cover may include a material stronger than the tub. According to the disclosure, a rigidity of the exhaust flow path may be reinforced.

The tub duct may include a partition rib 212 protruding to a rear of the tub back from an edge of the recess portion. The tub may include a plurality of tap holes 2121 provided along the partition rib to allow the duct cover to be coupled.

The bearing housing may include a fastening portion 51*a* protruding through the tub back. The duct cover may be coupled to the fastening portion of the bearing housing. According to the disclosure, the bearing housing and the duct cover may be directly coupled to each other.

The tub may further include a duct connection portion 270 configured to communicate the drying device with the tub duct.

The duct cover may be provided to cover an open side of the duct connection portion.

The duct cover may include a fastening flange portion 110 in which a plurality of fastening holes are formed. The duct cover may include a cover portion 120 protruding from the fastening flange portion in a direction away from the recess portion.

The housing may further include a rear frame, and a rear recess portion 10*ca* protruding from the rear frame in a direction away from the duct cover. The cover portion may be formed to have a protruding portion protruding toward the rear recess portion. According to the disclosure, interference between the duct cover and the housing may be prevented.

The tub may be disposed to be inclined upward toward a front of the tub. The cover portion may include a cover inclined portion 121 formed to allow a length protruding from the fastening flange portion to increase toward a lower side of the tub back, so as to be spaced apart from the rear frame of the housing by a predetermined distance. According to the disclosure, interference between the duct cover and the housing may be prevented.

The tub may further include a step portion 211 recessed forward from the recess portion to expand a cross-sectional area of the exhaust flow path. According to the disclosure, reduction in flow rate of the exhaust flow path may be alleviated.

The step portion 211 may be formed by recessing at least a portion of the recess portion 210 inward of the tub. According to the disclosure, reduction in flow rate of the exhaust flow path may be alleviated.

The tub may include a flow path expansion portion formed by at least a portion of the tub being cut, so as to expand a cross-sectional area of the exhaust flow path. According to the disclosure, reduction in flow rate of the exhaust flow path may be alleviated.

A plurality of tub exhaust ports may be provided. The plurality of tub exhaust ports may be spaced apart from each other.

According to an embodiment, a clothes care apparatus may include: a housing 10 in which a laundry inlet 14 is formed on a front; a tub 20 which is provided in the housing to store water, and includes a tub back 200 including a plurality of reinforcing ribs protruding rearward to reinforce a rigidity of the tub back and a tub duct 213 including a tub exhaust port 220 formed in a portion of the tub back to exhaust air in the tub and a recess portion 210 that is provided around the tub exhaust and is recessed further forward than rear ends of the plurality of reinforcing ribs; a drum 30 configured to be rotatable in the tub and accommodate laundry; and a drying device 70 disposed above the tub and configured to remove moisture from air exhausted from the tub and supply heated air to the tub, and may further include a duct cover 100 coupled to the tub to form an exhaust flow path P for guiding air, exhausted through the tub exhaust port, to the drying device by covering the tub duct. According to the disclosure, a space inside a washing machine may be secured. According to the disclosure, an exhaust flow path may be integrally formed with the tub back. According to the disclosure, a rigidity of the tub in which the exhaust flow path is formed may be reinforced.

The clothes care apparatus may further include a bearing housing including a material stronger than the tub, and configured to rotatably support a rotating shaft connected to the drum. The bearing housing may further include a recess reinforcement portion inserted into the recess portion to reinforce a rigidity of the recess portion, and a housing exhaust port corresponding to the tub exhaust port.

The bearing housing may include a fastening portion 51*a* protruding through the tub back. The duct cover may be coupled to the fastening portion of the bearing housing. The duct cover may include a fastening flange portion 110 in which a plurality of fastening holes are formed, and a cover portion 120 protruding from the fastening flange portion in a direction away from the recess portion.

The tub may further include a duct connection portion 270 configured to connect the drying device with the tub duct.

According to the disclosure, a space inside a washing machine may be secured.

According to the disclosure, an exhaust flow path may be integrally formed with a tub back.

According to the disclosure, a rigidity of the tub in which the exhaust flow path is formed may be reinforced.

The effects that may be achieved by the disclosure are not limited to the above-mentioned effects, and other effects not mentioned will be clearly understood by one of ordinary skill in the art to which the disclosure belongs from the disclosure.

Although disclosure has been shown and described in relation to specific embodiments, it would be appreciated by those skilled in the art that changes and modifications may be made in these embodiments without departing from the principles and scope of the disclosure, including the appended claims and their equivalents. It will also be understood that any of the embodiment(s) described herein may be used in conjunction with any other embodiment(s) described herein.

What is claimed is:

1. A clothes care apparatus, comprising:

a housing including a laundry inlet on a front;

a tub provided in the housing and configured to store water and including a tub back forming a rear side of the tub;

a drum configured to be rotatable in the tub and accommodate laundry; and a drying device disposed above the tub, and configured to remove moisture from air exhausted from the tub and supply heated air to the tub, wherein the tub back includes:

a plurality of reinforcing ribs protruding rearward to reinforce a rigidity of the tub back, and a tub duct formed in a portion of the tub back and configured to guide air exhausted from the tub to the drying device, and including a tub exhaust port configured to exhaust air in the tub and a recess portion recessed further forward than rear ends of the plurality of reinforcing ribs, the recess portion being formed in a rib-free region of the tub back and integrally recessed into the tub back so as to define part of an exhaust flow path.

2. The clothes care apparatus of claim 1, further comprising:

a bearing housing configured to rotatably support a rotating shaft connected to the drum, wherein the bearing housing comprises a recess reinforcement portion inserted in the recess portion and configured to reinforce a rigidity of the recess portion, and a housing exhaust port corresponding to the tub exhaust port.

3. The clothes care apparatus of claim 2, further comprising:

a duct cover coupled to the tub to cover the tub duct, and configured to form an exhaust flow path to guide air exhausted through the tub exhaust port to the drying device by covering the tub duct.

4. The clothes care apparatus of claim 3, wherein the tub duct comprises:

a partition rib protruding to a rear of the tub back from an edge of the recess portion; and a plurality of tap holes provided along the partition rib and configured to allow the duct cover to be coupled.

5. The clothes care apparatus of claim 3, wherein the bearing housing comprises a fastening portion protruding through the tub back, and the duct cover is coupled to the fastening portion of the bearing housing.

6. The clothes care apparatus of claim 3, wherein the tub further comprises a duct connection portion configured to communicate the drying device with the tub duct.

7. The clothes care apparatus of claim 6, wherein the duct cover is provided to cover an open side of the duct connection portion.

8. The clothes care apparatus of claim 3, wherein the duct cover comprises:

a fastening flange portion in which a plurality of fastening holes are formed; and a cover portion protruding from the fastening flange portion in a direction away from the recess portion.

9. The clothes care apparatus of claim 8, wherein the housing comprises a rear frame, and a rear recess portion protruding from the rear frame in a direction away from the duct cover, and the cover portion including a protruding portion protruding toward the rear recess portion.

10. The clothes care apparatus of claim 8, wherein the tub is disposed to be inclined upward toward a front of the tub, and the cover portion comprises a cover inclined portion configured to allow a length protruding from the fastening flange portion to increase toward a lower side of the tub back, so as to be spaced apart from the rear frame of the housing by a specified distance.

11. The clothes care apparatus of claim 10, wherein the tub further comprises a step portion recessed forward from the recess portion to expand a cross-sectional area of the exhaust flow path.

12. The clothes care apparatus of claim 11, wherein the step portion includes recessing at least a portion of the recess portion inward of the tub.

13. The clothes care apparatus of claim 3, wherein the tub comprises a flow path expansion portion formed by at least a cut portion of the tub, so as to expand a cross-sectional area of the exhaust flow path.

14. The clothes care apparatus of claim 1, wherein a plurality of tub exhaust ports are provided to be spaced apart from each other.

* * * * *